US012778372B2

(12) United States Patent
Li et al.

(10) Patent No.: US 12,778,372 B2
(45) Date of Patent: Nov. 3, 2026

(54) AUTOMATIC CLEANING APPARATUS

(71) Applicant: Beijing Roborock Technology Co., Ltd., Changping District (CN)

(72) Inventors: Xing Li, Changping District (CN); Pan Cheng, Changping District (CN); Chuanlin Duan, Changping District (CN); Erdong Gu, Changping District (CN); Rongxin Hu, Changping District (CN)

(73) Assignee: Beijing Roborock Technology Co., Ltd., Beijing (CN)

( * ) Notice: Subject to any disclaimer, the term of this patent is extended or adjusted under 35 U.S.C. 154(b) by 265 days.

(21) Appl. No.: 18/276,863

(22) PCT Filed: Jul. 2, 2021

(86) PCT No.: PCT/CN2021/104162
§ 371 (c)(1),
(2) Date: Aug. 10, 2023

(87) PCT Pub. No.: WO2022/170722
PCT Pub. Date: Aug. 18, 2022

(65) Prior Publication Data

US 2024/0122434 A1 Apr. 18, 2024

(30) Foreign Application Priority Data

Feb. 10, 2021 (CN) ..... 202110188181.5

(51) Int. Cl.
*A47L 11/40* (2006.01)
*A47L 11/24* (2006.01)
*A47L 11/284* (2006.01)

(52) U.S. Cl.
CPC ..... *A47L 11/4055* (2013.01); *A47L 11/24* (2013.01); *A47L 11/284* (2013.01); *A47L 11/4036* (2013.01); *A47L 11/4069* (2013.01)

(58) Field of Classification Search
CPC ..... A47L 11/00; A47L 11/40; A47L 11/4063; A47L 11/4069; A47L 11/4036;
(Continued)

(56) References Cited

U.S. PATENT DOCUMENTS 4,754,520 A 7/1988 Steadings et al.
5,991,951 A 11/1999 Kubo et al.
(Continued)

FOREIGN PATENT DOCUMENTS

AU 2014221266 A1 9/2014
CN 1252702 A 5/2000
(Continued)

OTHER PUBLICATIONS

Office Action issued in the corresponding U.S. Appl. No. 18/116,355, mailed May 21, 2024.
(Continued)

*Primary Examiner* — Carlos A. Rivera
(74) *Attorney, Agent, or Firm* — Morgan, Lewis & Bockius LLP

(57) ABSTRACT

An automatic cleaning apparatus that comprises a mobile platform configured to move automatically on an operation surface; a cleaning module disposed on the mobile platform and comprising: a dry-cleaning module configured to clean at least a part of the operation surface by means of dry cleaning; a wet-cleaning module configured to clean at least a part of the operation surface by means of wet cleaning; and a lifting and lowering structure connected to the dry-cleaning module or the wet-cleaning module and configured to enable the dry-cleaning module or the wet-cleaning module
(Continued)

to move vertically relative to the mobile platform. The wet-cleaning module comprises: a cleaning head for cleaning the operation surface, and a driving unit for driving the cleaning head to reciprocate along a target surface, and the target surface is a part of the operation surface.

15 Claims, 11 Drawing Sheets

(58) Field of Classification Search
CPC ..... A47L 11/4038; A47L 11/4041; A47L 11/4052; A47L 11/4058; A47L 11/4066; A47L 2201/06
See application file for complete search history.

(56) References Cited

U.S. PATENT DOCUMENTS

| | | | |
|---|---|---|---|
| 6,615,436 | B1 | 9/2003 | Burch, Jr. et al. |
| 8,863,342 | B2 | 10/2014 | Maguire et al. |
| 9,907,449 | B2 | 3/2018 | Lu et al. |
| 10,292,553 | B1 | 5/2019 | Ebrahimi Afrouzi et al. |
| 10,716,446 | B2 | 7/2020 | Isenberg et al. |
| 2005/0251937 | A1 | 11/2005 | Ruffo |
| 2006/0278161 | A1 | 12/2006 | Burkholder et al. |
| 2009/0133204 | A1 | 5/2009 | Lin |
| 2013/0167319 | A1 | 7/2013 | Tang |
| 2014/0068885 | A1 | 3/2014 | Fischer et al. |
| 2014/0182627 | A1 | 7/2014 | Williams et al. |
| 2015/0032259 | A1 | 1/2015 | Kim et al. |
| 2015/0320281 | A1 | 11/2015 | Ritterling et al. |
| 2016/0150934 | A1 | 6/2016 | Kim et al. |
| 2017/0150863 | A1 | 6/2017 | Kim et al. |
| 2017/0296010 | A1 | 10/2017 | Li et al. |
| 2018/0035860 | A1 | 2/2018 | Tsuboi et al. |
| 2018/0111513 | A1 | 4/2018 | Scott et al. |
| 2018/0141207 | A1 | 5/2018 | Klotz et al. |
| 2018/0242809 | A1 | 8/2018 | Reccanello |
| 2018/0255997 | A1 | 9/2018 | So et al. |
| 2019/0246858 | A1 | 8/2019 | Karasikov et al. |
| 2020/0019181 | A1 | 1/2020 | Kim et al. |
| 2020/0100637 | A1 | 4/2020 | Tanaka et al. |
| 2020/0196817 | A1 | 6/2020 | Fang |
| 2021/0034062 | A1 | 2/2021 | Ahn et al. |
| 2021/0034362 | A1 | 2/2021 | Williams et al. |
| 2021/0113038 | A1 | 4/2021 | Lee et al. |
| 2022/0047141 | A1 | 2/2022 | Xu et al. |
| 2022/0061610 | A1 | 3/2022 | Espin et al. |
| 2022/0071467 | A1 | 3/2022 | Zhang et al. |
| 2022/0079406 | A1* | 3/2022 | Zhang ..... A47L 11/4036 |
| 2022/0167821 | A1 | 6/2022 | Schnittman et al. |
| 2022/0248930 | A1 | 8/2022 | Li et al. |

FOREIGN PATENT DOCUMENTS

| | | | | |
|---|---|---|---|---|
| CN | 200987644 | Y | 12/2007 | |
| CN | 101349043 | A | 1/2009 | |
| CN | 101589935 | A | 12/2009 | |
| CN | 101657135 | A | 2/2010 | |
| CN | 102551591 | A | 7/2012 | |
| CN | 202589457 | U | 12/2012 | |
| CN | 202665478 | U | 1/2013 | |
| CN | 105982626 | A | 10/2016 | |
| CN | 106166050 | A | 11/2016 | |
| CN | 206166838 | U | 5/2017 | |
| CN | 107184156 | A | 9/2017 | |
| CN | 107510417 | A | 12/2017 | |
| CN | 107788913 | A | 3/2018 | |
| CN | 108829115 | A | 11/2018 | |
| CN | 109199205 | A | 1/2019 | |
| CN | 109394086 | A | 3/2019 | |
| CN | 109528093 | A | 3/2019 | |
| CN | 208598297 | U | 3/2019 | |
| CN | 109549573 | A | 4/2019 | |
| CN | 109602352 | A | 4/2019 | |
| CN | 109645893 | A | 4/2019 | |
| CN | 109730588 | A | 5/2019 | |
| CN | 208851397 | U | 5/2019 | |
| CN | 109984688 | A | 7/2019 | |
| CN | 110215166 | A | 9/2019 | |
| CN | 110393477 | A | 11/2019 | |
| CN | 110448241 | A | 11/2019 | |
| CN | 110507253 | A | 11/2019 | |
| CN | 110558900 | A | 12/2019 | |
| CN | 110680253 | A | 1/2020 | |
| CN | 110710931 | A | 1/2020 | |
| CN | 110710932 | A | 1/2020 | |
| CN | 110934545 | A | 3/2020 | |
| CN | 210383772 | U | 4/2020 | |
| CN | 111208811 | A | 5/2020 | |
| CN | 111345744 | A | 6/2020 | |
| CN | 111345745 | A | 6/2020 | |
| CN | 210871312 | U | 6/2020 | |
| CN | 111374609 | A | 7/2020 | |
| CN | 111375575 | A | 7/2020 | |
| CN | 111427357 | A | 7/2020 | |
| CN | 111449560 | A | 7/2020 | |
| CN | 111481097 | A | 8/2020 | |
| CN | 111568325 | A | 8/2020 | |
| CN | 111588317 | A * | 8/2020 | ..... A47L 11/40 |
| CN | 211324758 | U | 8/2020 | |
| CN | 211559965 | U | 9/2020 | |
| CN | 111728536 | A | 10/2020 | |
| CN | 211796249 | U | 10/2020 | |
| CN | 111870196 | A | 11/2020 | |
| CN | 111904346 | A | 11/2020 | |
| CN | 112065118 | A | 12/2020 | |
| CN | 112137518 | A | 12/2020 | |
| CN | 112568810 | A | 3/2021 | |
| CN | 112690713 | A | 4/2021 | |
| CN | 112716373 | A | 4/2021 | |
| CN | 112790672 | A | 5/2021 | |
| CN | 112806915 | A | 5/2021 | |
| CN | 112806916 | A | 5/2021 | |
| CN | 112806917 | A | 5/2021 | |
| CN | 113693499 | A | 11/2021 | |
| CN | 215687460 | U | 2/2022 | |
| DE | 102015104755 | A1 | 9/2016 | |
| JP | 2000007172 | A | 1/2000 | |
| JP | 2003-135347 | A | 5/2003 | |
| JP | 2005533567 | A | 11/2005 | |
| JP | 2007286730 | A | 11/2007 | |
| JP | 2009095361 | A | 5/2009 | |
| JP | 2010-075538 | A | 4/2010 | |
| JP | 2013-250748 | A | 12/2013 | |
| JP | 2015512684 | A | 4/2015 | |
| JP | 2016000074 | A | 1/2016 | |
| JP | 2016-021181 | A | 2/2016 | |
| JP | 2018-114067 | A | 7/2018 | |
| JP | 2018196622 | A | 12/2018 | |
| JP | 2019-058803 | A | 4/2019 | |
| JP | 2019084095 | A | 6/2019 | |
| JP | 2019109845 | A | 7/2019 | |
| JP | 2019-141235 | A | 8/2019 | |
| JP | 2020-037023 | A | 3/2020 | |
| JP | 2020-194415 | A | 12/2020 | |
| JP | 2022-524826 | A | 5/2022 | |
| KR | 20050012047 | A * | 1/2005 | ..... A47L 5/30 |
| KR | 10-2012-0055891 | A | 6/2012 | |
| KR | 10-2012-0088314 | A | 8/2012 | |
| KR | 20-2012-0008518 | U | 12/2012 | |
| KR | 10-2014-0032015 | A | 3/2014 | |
| KR | 10-2014-0123682 | A | 10/2014 | |
| KR | 20140126433 | A | 10/2014 | |
| KR | 101803892 | B1 | 12/2017 | |
| KR | 10-2019-0081316 | A | 7/2019 | |
| RU | 2517013 | C1 | 5/2014 | |
| RU | 2579137 | C1 | 3/2016 | |
| RU | 2620236 | C1 | 5/2017 | |
| RU | 2697154 | C1 | 8/2019 | |
| TW | 201338747 | A | 10/2013 | |
| TW | 202002880 | A | 1/2020 | |
| TW | 202112292 | A | 4/2021 | |

(56) References Cited

FOREIGN PATENT DOCUMENTS

| | | | |
|---|---|---|---|
| TW | M633591 | U | 11/2022 |
| WO | 2016/036183 | A1 | 3/2016 |
| WO | 2018/162725 | A1 | 9/2018 |
| WO | 2019/233493 | A1 | 12/2019 |
| WO | 2020/125774 | A1 | 6/2020 |
| WO | 2020/181724 | A1 | 9/2020 |
| WO | 2020/186583 | A1 | 9/2020 |
| WO | 2021/008611 | A1 | 1/2021 |
| WO | 2021/136023 | A1 | 7/2021 |
| WO | 2021/228208 | A1 | 11/2021 |
| WO | 2022/116584 | A1 | 6/2022 |

OTHER PUBLICATIONS

Office Action issued in the corresponding TW Application No. 112149355, mailed May 31, 2024.
Office Action issued in the corresponding JP Application No. 2023-543382, mailed Jun. 25, 2024.
International Search Report (with partial translation) and Written Opinion dated Nov. 2, 2021, for corresponding International Patent Application No. PCT/CN2021/104162.
International Search Report issued in related International Patent Application No. PCT/CN2021/099201 dated Oct. 27, 2021.
International Search Report issued in related International Patent Application No. PCT/CN2021/099231 dated Sep. 28, 2021.
International Search Report issued in related International Patent Application No. PCT/CN2022/075724 dated May 6, 2022.
Office Action dated Apr. 15, 2022, issued in corresponding Chinese Patent Application No. 202110188181.5.
Office Action dated Jan. 10, 2023, issued in corresponding Chinese Patent Application No. 202110188181.5.
Office Action dated Apr. 27, 2022, issued in related Chinese Patent Application No. 202110184810.7.
Office Action dated Sep. 23, 2021, issued in related Chinese Patent Application No. 202110138563.7.
Office Action dated Dec. 28, 2022, issued in related Taiwanese Patent Application No. 111114721.
Office Action dated Jun. 27, 2022, issued in related U.S. Appl. No. 17/678,559.
Office Action issued in corresponding Chinese Patent Application No. 202211414404.6, dated Jul. 30, 2025.
Notice of Allowance issued in corresponding Japanese Patent Application No. 2023-540845, dated May 20, 2025.
Reconsideration Report by Examiner before Appeal issued in corresponding Japanese Patent Application No. 2023-543382, dated Aug. 6, 2025.
Office Action issued in corresponding Taiwanese Patent Application No. 114116176, dated Jun. 23, 2025.
Action issued in related U.S. Appl. No. 18/270,989, dated Aug. 11, 2025.
Extended European Search Report issued in corresponding European Patent Application No. 21925366.3, dated Dec. 13, 2024.
Extended European Search Report issued in corresponding European Patent Application No. 21925375.4, dated Dec. 19, 2024.
Decision of Refusal issued in corresponding Japanese Patent Application No. 2023-543382, dated Dec. 24, 2024.
Office Action issued in corresponding Korean Patent Application No. 10-2023-7026473, dated Feb. 27, 2025.
Non-Final Office Action issued in the corresponding U.S. Appl. No. 18/116,355, dated Feb. 15, 2024.
Office Action issued in corresponding Chinese Patent Application No. 202110188182.X, dated Mar. 30, 2022 with the English translation.
Office Action issued in corresponding Chinese Patent Application No. 202110483998.5, dated Mar. 26, 2026 with the English translation.
Notice of Allowance issued in the corresponding Chinese Patent Application No. 202211414404.6, dated Mar. 23, 2026 with the English translation.
Office Action issued in corresponding Korean Patent Application No. 10-2023-7025546, dated Mar. 27, 2026 with the English translation.
International Search Report issued in corresponding International Patent Application No. PCT/CN2021/104339, dated Oct. 26, 2021.
Extended European Search Report issued in corresponding European Patent Application No. 21925377.0, dated Jan. 14, 2025.
Final Office Action issued in corresponding U.S. Appl. No. 18/276,814, dated Mar. 24, 2026.
Non-Final Office Action issued in corresponding U.S. Appl. No. 18/276,814, dated Oct. 16, 2025.
Final Office Action issued in corresponding U.S. Appl. No. 18/270,989, dated Feb. 13, 2026.
Non-Final Office Action issued in corresponding U.S. Appl. No. 18/546,647, dated Feb. 6, 2026.
Office Action issued in corresponding Chinese Patent Application No. 202211678780.6, dated Nov. 22, 2025.
Office Action issued in corresponding Russian Patent Application No. 2025115015, dated Oct. 21, 2025.
Non-Final Office Action issued in corresponding United States U.S. Appl. No. 18/276,814, dated Oct. 16, 2025.
Office Action issued in corresponding Chinese Patent Application No. 202311515672.1, dated May 26, 2026.
Office Action issued in corresponding U.S. Appl. No. 18/276,814, dated Jul. 2, 2026.
Office Action issued in corresponding Chinese Patent Application No. 202211678780.6, dated Jul. 15, 2026.
Office Action issued in corresponding Australian Patent Application No. 2025205585, dated Jul. 24, 2026.

* cited by examiner

AUTOMATIC CLEANING APPARATUS

CROSS-REFERENCE TO RELATED APPLICATION

This application is a 35 U.S.C. 371 national phase application of PCT International Application No. PCT/CN2021/104162 filed on Jul. 2, 2021, which claims priority to Chinese Patent Application No. 202110188181.5, filed on Feb. 10, 2021, both of which are incorporated herein by reference in their entireties as a part of the present application.

TECHNICAL FIELD

The present application relates to the field of cleaning robot technologies and more particularly to an automatic cleaning apparatus.

BACKGROUND

Currently, there are two main types of cleaning robots, that is, a ground-sweeping robot and a ground-mopping robot. The ground-sweeping robot or the ground-mopping robot has a single function, and may only be used for sweeping or mopping the ground. If it is desired to sweep and mop the ground at the same time, the two apparatus have to be prepared at the same time, occupying a double space.

In the relevant art, the ground-sweeping robot and the ground-mopping robot may be combined. A mop cloth is added at an end of the ground-sweeping robot to obtain a ground sweeping and mopping integrated robot. However, the ground-mopping function of the ground sweeping and mopping integrated robot is realized only by enabling a mop cloth to translate on the ground. With the translation movement of the mop cloth, the ground is mopped just one time in a movement trajectory of the cleaning robot, which renders the effect and efficiency of mopping the ground to be greatly reduced, especially for some environments with heavy stains and dirty ground, where obviously the ground cannot be cleaned up by mopping the ground once in a moving manner. In addition, there are other problems with an automatic cleaning apparatus. For example, a cleaning component on the cleaning apparatus cannot be lifted and lowered but is always closely attached to a cleaned surface. As a result, it is difficult for the cleaning apparatus to move freely on the cleaned surface, or the cleaning apparatus resists moving on the cleaned surface when the cleaning apparatus does not operate for cleaning.

SUMMARY

An object of the present invention is to provide an automatic cleaning apparatus, which can solve the technical problem when the ground cannot be cleaned up. The specific solutions are as follows.

According to specific embodiments of the present invention, the present invention provides an automatic cleaning apparatus, including:

- a mobile platform 100, configured to move automatically on an operation surface; and
- a cleaning module 150, disposed on the mobile platform 100 and including:
- a dry-cleaning module 151, configured to clean at least a part of the operation surface by means of dry cleaning;

- a wet-cleaning module 400, configured to clean at least a part of the operation surface by means of wet cleaning; and
- a lifting and lowering structure 500, connected to the dry-cleaning module 151 or the wet-cleaning module 400 and configured to enable the dry-cleaning module 151 or the wet-cleaning module 400 to move vertically relative to the mobile platform 100, wherein the wet-cleaning module 400 includes a cleaning head 410 for cleaning the operation surface, and a driving unit 420 for driving the cleaning head 410 to reciprocate along a target surface, the target surface being a part of the operation surface.

Optionally, the lifting and lowering structure 500 is a parallelogram structure and includes:

- a first connection end 501, for providing active power to switch the dry-cleaning module 151 or the wet-cleaning module 400 between a lifted state and a lowered state;
- a second connection end 502, disposed opposite to the first connection end 501 and being rotated under the action of the active power.

Optionally, the first connection end 501 includes a first bracket 5011 fixedly connected to a bottom of the mobile platform 100; and the first bracket 5011 includes:

- a cross beam 50111;
- a sliding slot 50112, extending along a surface of the cross beam 50111; and
- a snapping hole 50113, running through the cross beam 50111 and disposed at an extending end of the sliding slot 50112.

Optionally, the first connection end 501 further includes a first connection rod pair 5012, one end of which is rotatably connected to the mobile platform 100, and the other end of which is rotatably connected to the dry-cleaning module 151 or the wet-cleaning module 400, wherein the first connection rod pair 5012 includes a first connection rod 50121 and a second connection rod 50122 that are arranged in parallel, wherein a first end of each of the first connection rod 50121 and the second connection rod 50122 is rotatably connected to the mobile platform 100 through a movable stud, and a second end of each of the first connection rod 50121 and the second connection rod 50122 is rotatably connected to the dry-cleaning module 151 or the wet-cleaning module 400 through a movable stud.

Optionally, the first connection end 501 further includes a power assembly for providing pulling power to rotate the first connection rod pair 5012 within a preset angle:

- the lifting and lowering structure 500 further includes a cable 5013 for providing a pulling power to rotate the first connection rod pair 5012 within a preset angle, wherein the cable 5013 includes:
- a cable motor terminal 50131 connected to the driving unit 420; and a cable bracket terminal 50132 connected to the first bracket 5011, wherein a motor lifts or lowers the second end of each of the first connection rod 50121 and the second connection rod 50122 through the cable 42194.

Optionally, the second connection end 502 includes a second connection rod pair 5022, one end of which is rotatably connected to the mobile platform 100, and the other end of which is rotatably connected to the wet-cleaning module 400, wherein the second connection rod pair 5022 rotates with the rotation of the first connection rod pair 5012.

Optionally, the second connection rod pair 5022 includes a third connection rod 50221 and a fourth connection rod 50222 that are arranged in parallel, wherein a first end of each of the third connection rod 50221 and the fourth connection rod 50222 is rotatably connected to the mobile platform 100 through a movable stud, and a second end of each of the third connection rod 50221 and the fourth connection rod 50222 is rotatably connected to the wet-cleaning module 400 through a movable stud.

Optionally, the driving unit 420 includes:

a driving platform 421, connected to a bottom surface of the mobile platform 100 for providing a driving force; and a support platform 422, detachably connected to the driving platform 421 for supporting the cleaning head 410.

Optionally, the driving platform 421 includes:

a motor 4211, disposed on a side of the driving platform 421 close to the mobile platform 100 and used for outputting power by a motor output shaft, a driving wheel 4212, connected to the motor output shaft and having an asymmetric structure; and a vibrating member 4213, disposed on a side of the driving platform 421 opposite to the motor 4211 and connected to the driving wheel 4212, and configured to reciprocate under the asymmetrical rotation of the driving wheel 4212.

Optionally, the driving platform 421 further includes:

a connection rod 4214, extending along an edge of the driving platform 421 and used for connecting the driving wheel 4212 and the vibrating member 4213 so that the vibrating member 4213 extends to a preset position.

Optionally, the driving platform 421 further includes a vibration buffer device 4215, disposed on the connection rod 4214 for reducing vibration in a specific direction.

Optionally, the support platform 422 includes:

a cleaning substrate 4221, disposed movably on the support platform 422, wherein the cleaning substrate 4221 reciprocates relative to the support platform 422 under the vibration of the vibrating member 4213.

Optionally, the support platform 422 further includes:

an elastic detaching button 4229, disposed on at least one side of the support platform 422 for detachably connecting the support platform 422 to the driving platform 421.

Optionally, the support platform 422 further includes:

at least one assembling region 4224, disposed on the support platform 422 for assembling the cleaning head 410.

Optionally, the cleaning head 410 includes:

a movable region 412, connected to the cleaning substrate 4221 and configured to reciprocate along the target surface under the driving of the cleaning substrate 4221; and a fixed region 411, connected to a bottom of the support platform 422 through the at least one assembling region 4224, wherein the fixed region 411 cleans at least a part of the operation surface along with the movement of the support platform 422.

Optionally, the cleaning head 410 further includes:

a flexible connection portion 413, disposed between the fixed region 411 and the movable region 412 for connecting the fixed region 411 and the movable region 412.

Optionally, the cleaning head 410 further includes:

a sliding buckle 414, extending along an edge of the cleaning head 410 and detachably mounted on the support platform 422.

Compared with the relevant art, embodiments of the present invention have the following technical effects.

Since the cleaning module of the automatic cleaning apparatus is provided with the dry-cleaning module and the wet-cleaning module, the sweeping and mopping integrated cleaning apparatus according to the present invention can provide a more comprehensive cleaning function. Meanwhile, the driving unit and a vibrating region are added to the wet-cleaning module, so that the cleaning head can reciprocate so as to repeatedly clean a surface to be cleaned. Thus, in a movement trajectory of a cleaning robot, a region may be cleaned several times when the cleaning robot passes through the region just one time, thereby greatly enhancing the cleaning effect. Especially for regions with heavy stains, the cleaning effect becomes obvious.

Through the lifting and lowering structure disposed between the cleaning module and the mobile platform, the cleaning module can be lifted and lowered relative to the mobile platform. When a ground-mopping task is performed, the cleaning module is lowered to make contact with the ground. When the ground-mopping task is completed, the cleaning module is lifted to release from the ground. Therefore, an increase in resistance of the cleaning apparatus, when the cleaning apparatus moves freely on the surface to be cleaned, is avoided due to the existence of the cleaning module.

BRIEF DESCRIPTION OF THE DRAWINGS

The accompanying drawings here are incorporated in the description and constitute a part of the description, show embodiments conforming to the present invention, and are used together with the description to explain the principles of the present invention. Apparently, the accompanying drawings in the following description show only some embodiments of the present invention, and a person of ordinary skill in the art may still derive other drawings from these accompanying drawings without creative efforts. In the accompanying drawings.

LIST OF REFERENCE NUMERALS

Figure 1:
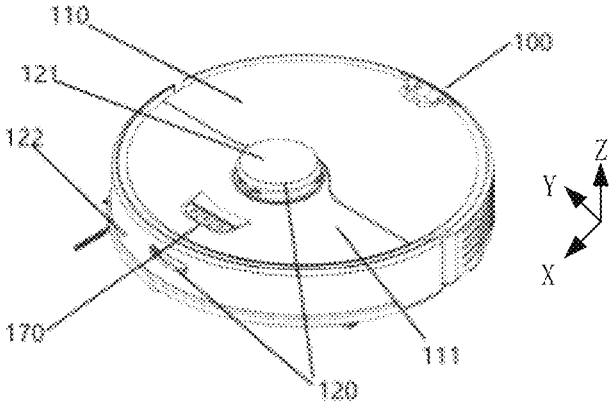
FIG. 1 is an oblique view of an automatic cleaning apparatus according to an embodiment of the present invention.

100—mobile platform 100, 110—rearward portion, 111—forward portion, 120—sensing system, 121—position determination device, 122—buffer, 123—cliff sensor, 130—control system. 140—driving system, 141—driving wheel assembly, 142—steering assembly. 143—elastic element, 146—driving motor, 150—cleaning module, 151—dry—cleaning module, 152—dust box, 153—filtering mesh, 154—dustsucking port, 155—air outlet, 156—blower, 160—energy system, 170—human-computer interaction system, 400—wet-cleaning module, 410—cleaning head, 420—driving unit, 421—driving platform. 422—support platform, 4211—motor, 4212—driving wheel, 4213—vibrating member, 4214—connection rod, 4215—vibration buffer device, 4216—pawl, 4217—water-discharging device, 4218—clean water pump pipe, 4219—clean water pump, 42191—water inlet, 42192—water outlet, 42193—gear set, 42195—clutch, 42196—cable gear, 4221—cleaning substrate, 42211—assembling notch. 42212—first limiting portion, 42213—second limiting portion, 42214—water-discharging hole, 4229—elastic detaching button, 4224—assembling region, 4225—slider, 4222—first sliding slot, 4223—second sliding slot, 4228—pivot, 525—first slider, 528—second slider. 512 (4227)—swiveling end, 514 (4226)—sliding end, 516 (624)—first pivot, 518 (626)—second pivot, 800 (600, 700)—driving mechanism, 500—four-link lifting and lowering structure, 501—first connection end, 502—second connection end, 5011—first bracket, 5012—first connection rod pair, 50121—first connection rod, 50122—second connection rod, 5013—cable, 50131—cable motor terminal, 50132—cable bracket terminal, 50111—cross beam, 50112—sliding slot, 50113—snapping hole, 50114—first longitudinal beam, 50115—second longitudinal beam, 5021—second bracket, 5022—second connection rod pair, 50221—third connection rod, 50222—fourth connection rod, 601—first fixed bracket, 6011—first fixed portion, 6012—second fixed portion, 602—second fixed bracket, 603—connection rod pair, 6031—first connection rod pair, 60311—first connection rod, 60312—second connection rod, 6032—second connection rod pair, 60321—third connection rod, 60322—fourth connection rod.

DETAILED DESCRIPTION

To make the objectives, technical solutions and advantages of the present invention clearer, the present invention will be further described in detail below with reference to the accompanying drawings. It is obvious that the described embodiments are only part but not all of the embodiments of the present invention. All other embodiments obtained by those of ordinary skill in the art without creative efforts based on the embodiments in the present invention are within the protection scope of the present invention.

The terms used in the embodiments of the present invention are for the purpose of describing particular embodiments only and are not intended to limit the present invention. The singular forms "a/an," "said" and "the" used in the embodiments of the present invention and the appended claims are intended to include the plural forms as well, unless the context clearly indicates otherwise. The term "a plurality of" generally means at least two.

It should be understood that the term "and/or" used herein merely describes an association relationship of associated objects, and indicates that there may be three relationships. For example, A and/or B may indicate three cases: A exists separately, A and B exist at the same time, and B exists separately. In addition, the character "/" herein generally indicates an "or" relationship between the associated objects.

It should be understood that although the terms "first," "second," "third," etc., may be used to describe elements in the embodiments of the present invention, these elements should not be limited to these terms. These terms are only used to distinguish one element from another. For example, "first" may also be referred to as "second" without departing from the scope of the embodiments of the present invention. Similarly, "second" may also be referred to as "first."

It should also be noted that the term "includes" or any other variants are intended to cover the non-exclusive inclusion, such that the commodities or devices including a series of elements not only include those elements, but also include other unclearly listed elements, or also include the inherent elements of such commodities or devices.

The alternative embodiments of the present invention will be described in detail below with reference to the accompanying drawings.

Figure 2:
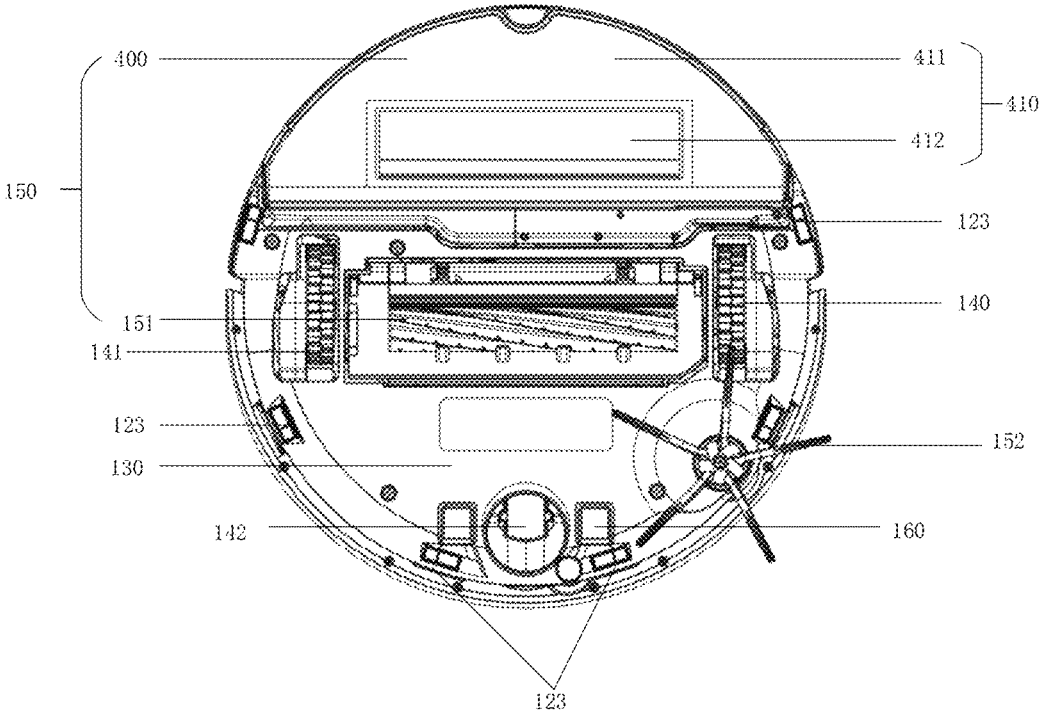
FIG. 2 is a schematic structural diagram of the bottom of an automatic cleaning apparatus according to an embodiment of the present invention.

FIGS. 1-2 are schematic structural diagrams of an automatic cleaning apparatus according to an exemplary embodiment. As shown in FIGS. 1-2, the automatic cleaning apparatus may be a vacuum ground-sucking robot, a ground-mopping/brushing robot, or a window-cleaning robot, etc. The automatic cleaning apparatus may include a mobile platform 100, a sensing system 120, a control system 130, a driving system 140, a cleaning module 150, an energy system 160, and a human-computer interaction system 170.

The mobile platform 100 may be configured to move automatically on an operation surface in a target direction. The operation surface may be a surface to be cleaned by the automatic cleaning apparatus. In some embodiments, the automatic cleaning apparatus may be a ground-mopping robot, and thus the automatic cleaning apparatus operates on the ground, and the ground is the operation surface. The automatic cleaning apparatus may also be a window-cleaning robot, and thus the automatic cleaning apparatus operates on an outer surface of the glass of a building, and the glass is the operation surface. The automatic cleaning apparatus may also be a pipe-cleaning robot, and thus the automatic cleaning apparatus operates on an inner surface of a pipe, and the inner surface of the pipe is the operation surface. For the purpose of presentation only, the following description in the present application uses a ground-mopping robot as an example for illustration.

In some embodiments, the mobile platform 100 may be an autonomous mobile platform, or a non-autonomous mobile platform. The autonomous mobile platform means that the mobile platform 100 itself can automatically and adaptively make an operational decision based on an unexpected environmental input. The non-autonomous mobile platform means that the mobile platform 100 itself cannot adaptively make an operational decision based on an unexpected environmental input but can execute a given procedure or operate according to a certain logic. Accordingly, when the mobile platform 100 is the autonomous mobile platform, the target direction may be determined autonomously by the automatic cleaning apparatus. When the mobile platform 100 is the non-autonomous mobile platform, the target direction may be set systematically and manually. When the mobile platform 100 is the autonomous mobile platform, the mobile platform 100 includes a forward portion 111 and a rearward portion 110.

The sensing system 120 includes a position determination device 121 located above the mobile platform 100, a buffer 122 located at the forward portion 111 of the mobile platform 100, a cliff sensor 123 located at a bottom of the mobile platform 100, and sensing devices such as an ultrasonic sensor (not shown in the figures), an infrared sensor (not shown in the figures), a magnetometer (not shown in the figures), an accelerometer (not shown in the figures), a gyroscope (not shown in the figures), and an odometer (not shown in the figures), for providing various position information and motion state information of the automatic cleaning apparatus to the control system 130.

In order to more clearly describe operations of the automatic cleaning apparatus, the following directions are defined. The automatic cleaning apparatus may travel on the ground by various combinations of movements relative to the following three mutually perpendicular axes defined by the mobile platform 100: a transversal axis X, a front and rear axis Y, and a center vertical axis Z. A forward-driving direction along the front and rear axis Y is designated as "forward," and a rearward-driving direction along the front and rear axis Y is designated as "rearward." The transversal axis X extends substantially between a right wheel and a left wheel of the automatic cleaning apparatus along an axis center defined by a center point of the driving wheel assembly 141. The automatic cleaning apparatus may rotate around the X axis. It is called "pitch up" when the forward portion of the automatic cleaning apparatus is tilted upward and the rearward portion thereof is tilted downward. It is called "pitch down" when the forward portion of the automatic cleaning apparatus is tilted downward and the rearward portion thereof is tilted upward. In addition, the automatic cleaning apparatus may rotate about the Z axis. In the forward direction of the automatic cleaning apparatus, it is called "turn right" when the automatic cleaning apparatus is tilted to the right side of the Y axis, and it is called "turn left" when the automatic cleaning apparatus is tilted to the left side of the Y axis.

As shown in FIG. 2, cliff sensors 123 are provided at the bottom of the mobile platform 100 and in the front and rear of the driving wheel assembly 141, respectively, for preventing the automatic cleaning apparatus from falling off when the automatic cleaning apparatus retreats, so as to avoid damage to the automatic cleaning apparatus. The aforementioned "front" refers to the side that is the same as the traveling direction of the automatic cleaning apparatus, and the aforementioned "rear" refers to the side opposite to the traveling direction of the automatic cleaning apparatus.

The position determination device 121 includes, but is not limited to, a camera and a laser distance sensor (LDS).

The various components in the sensing system 120 may operate independently, or operate together to achieve a target function more accurately. The surface to be cleaned is identified through the cliff sensor 123 and the ultrasonic sensor to determine physical properties of the surface to be cleaned, including the surface material, degree of cleanliness, etc., which may be more accurately determined in combination with the camera and the LDS, etc.

For example, the ultrasonic sensor may determine whether the surface to be cleaned is a carpet. If the ultrasonic sensor determines that the surface to be cleaned is made of a carpet material, the control system 130 controls the automatic cleaning apparatus to perform cleaning in a carpet mode.

The forward portion 111 of the mobile platform 100 is provided with the buffer 122. During cleaning, when the driving wheel assembly 141 propels the automatic cleaning apparatus to travel on the ground, the buffer 122 detects one or more events (or objects) in the traveling path of the automatic cleaning apparatus via a sensor system such as an infrared sensor, and the automatic cleaning apparatus may control the driving wheel assembly 141 based on the events (or objects) detected by the buffer 122, such as obstacles and walls, so as to cause the automatic cleaning apparatus to respond to the events (or objects), such as moving away from the obstacles.

The control system 130 is disposed on a main circuit board inside the mobile platform 100, and includes a computing processor, such as a central processing unit and an application processor, that communicates with a non-transitory memory such as a hard disk, a flash memory, and a random-access memory. The application processor is configured to receive environmental information sensed by a plurality of sensors and transmitted from the sensing system 120; generate a simultaneous map of an environment where the automatic cleaning apparatus is located based on obstacle information fed back by the laser distance sensor by use of a positioning algorithm, such as Simultaneous Localization And Mapping (SLAM); autonomously determine a traveling path based on the environmental information and the environmental map; and then control the driving system 140 to perform operations such as traveling forward, traveling backward, and/or steering based on the autonomously determined traveling path. Further, the control system 130 may also determine whether to activate the cleaning module 150 to perform a cleaning operation based on the environmental information and the environmental map.

Specifically, based on distance information and speed information that are fed back by the buffer 122, the cliff sensor 123 and sensing devices such as the ultrasonic sensor, the infrared sensor, the magnetometer, the accelerometer, the gyroscope, and the odometer, the control system 130 may comprehensively determine a current operation state of the ground-sweeping robot, such as crossing a doorsill, getting on a carpet, locating at the edge of a cliff, getting stuck from above or below, having a full dust box, being picked up, etc. Further, the control system 130 may also give a specific next-action strategy for different situations, so that the operation of the automatic cleaning apparatus meets the owner's requirements and a better user experience is provided. Further, the control system may plan the most efficient and reasonable cleaning path and cleaning mode based on the simultaneous map generated by SLAM, which greatly improves the cleaning efficiency of the automatic cleaning apparatus.

Figure 3:
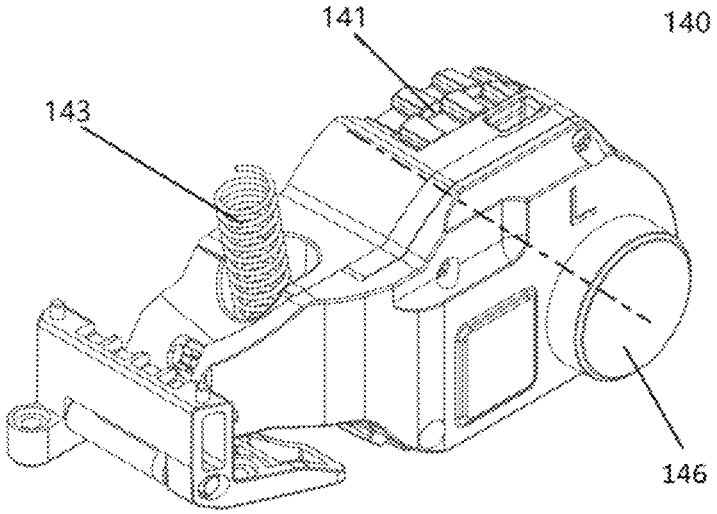
FIG. 3 is an oblique view of a driving wheel assembly on one side according to an embodiment of the present invention.
Figure 4:
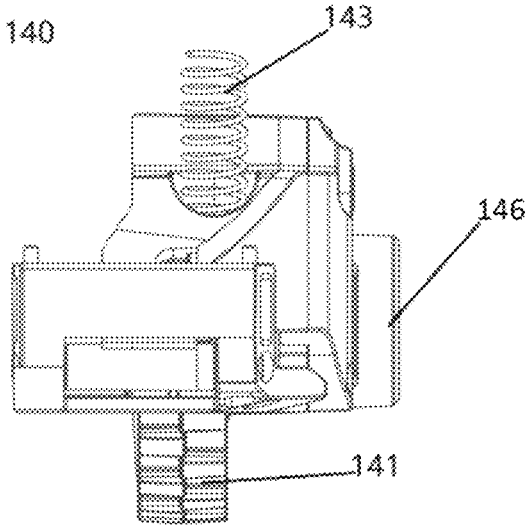
FIG. 4 is a front view of a driving wheel assembly on one side according to an embodiment of the present invention.

The driving system 140 may execute a driving command based on specific distance and angular information, such as x, y, and θ components, so as to manipulate the automatic cleaning apparatus to travel across the ground. FIGS. 3 and 4 are an oblique view and a front view, respectively, of a driving wheel assembly 141 on one side according to an embodiment of the present invention. As shown in the figures, the driving system 140 includes the driving wheel assembly 141, and the driving system 140 may control a left wheel and a right wheel simultaneously. In order to more precisely control the motion of the automatic cleaning apparatus, the driving system 140 preferably includes a left driving wheel assembly and a right driving wheel assembly, respectively. The left driving wheel assembly and the right driving wheel assembly are arranged symmetrically along the transverse axis defined by the mobile platform 100. The driving wheel assembly includes a body portion, a driving wheel, and an elastic element. One end of the body portion is connected to a frame. The driving wheel is disposed at the body portion and driven by a driving motor 146. The elastic element is connected between the body portion and the frame and is configured to provide an elastic force between the frame and the body portion. The driving motor 146 is located outside the driving wheel assembly 141, and an axis center of the driving motor 146 is located within a cross-sectional projection of the driving wheel. The driving wheel assembly 141 may also be connected to a circuit for measuring a driving current and the odometer.

In order for the automatic cleaning apparatus to move on the ground more stably or have a higher movement ability, the automatic cleaning apparatus may include one or more steering assemblies 142. The steering assembly 142 may be a driven wheel or a driving wheel, and structurally includes but is not limited to a universal wheel. The steering assembly 142 may be located in front of the driving wheel assembly 141.

The driving motor 146 provides power for rotation of the driving wheel assembly 141 and/or the steering assembly 142.

The driving wheel assembly 141 may be detachably connected to the mobile platform 100 to facilitate disassembly, assembly, and maintenance. The driving wheel may have an offset drop suspension system that is movably fastened, e.g., rotatably attached, to the mobile platform 100 of the automatic cleaning apparatus and maintains contact and traction with the ground at a certain grounding force by an elastic element 143 such as a tension spring or a compression spring. In the meanwhile, the cleaning module 150 of the automatic cleaning apparatus is also in contact with the surface to be cleaned at a certain pressure.

The energy system 160 includes a rechargeable battery, such as a nickel-hydride battery and a lithium battery. The rechargeable battery may be connected with a charging control circuit, a battery pack charging-temperature detecting circuit, and a battery undervoltage-monitoring circuit. The charging control circuit, the battery pack charging temperature-detecting circuit, and the battery undervoltage-monitoring circuit are further connected to a single-chip microcomputer control circuit. A host of the automatic cleaning apparatus is connected to a charging pile through a charging electrode disposed on a side of or below a body of the automatic cleaning apparatus for the purpose of charging. If there is dust on the bare charging electrode, due to an accumulation effect of charges during charging, a plastic body of the automatic cleaning apparatus around the electrode will be melted and deformed, and even the electrode itself will be deformed and thus is unable to continue the normal charging of the automatic cleaning apparatus.

The human-computer interaction system 170 includes buttons on a host panel of the automatic cleaning apparatus, and the buttons are used by a user to select functions. The human-computer interaction system 170 may also include a display screen and/or an indicator light and/or a horn. The display screen, the indicator light, and the horn present a current state or function items of the automatic cleaning apparatus to the user. The human-computer interaction system 170 may also include a mobile client program. For a route navigation type of cleaning apparatus, the mobile client may present a map of the environment where the apparatus is located, as well as a location of the apparatus, to the user, which may provide the user with richer and more user-friendly function items.

The cleaning module 150 may include a dry-cleaning module 151 and/or a wet-cleaning module 400.

As shown in FIGS. 5-8, the dry-cleaning module 151 includes a rolling brush, a dust box, a blower, and an air outlet. The rolling brush having a certain interference with the ground sweeps up garbage on the ground and rolls up the garbage to the front of a dust-sucking port between the rolling brush and the dust box. Then, the garbage is sucked into the dust box by air that has a sucking force, is generated by the blower, and passes through the dust box. The dust-removal capacity of the ground-sweeping robot may be characterized by the dust pickup efficiency (DPU) of the garbage. DPU is affected by the structure and material of the rolling brush; the utilization rate of air in an air passage formed by the dust-sucking port, the dust box, the blower, the air outlet, and connection components among the dust-sucking port, the dust box, the blower, and the air outlet; and the type and power of the blower, which is a complex system design problem. Compared with an ordinary plug-in vacuum cleaner, the improvement of dust removal capacity is more meaningful for an automatic cleaning apparatus with limited energy. Because the improvement of the dust removal capacity directly and effectively reduces the demand for energy, that is to say, the original cleaning apparatus that may clean 80 square meters of ground on a single charge may be evolved to clean 180 square meters or more on a single charge. In addition, the service life of the battery having a reduced number of charging times will also be greatly increased, so that the frequency in replacing the battery by the user will also be decreased. What is more intuitive and important is that the improvement of the dust removal capacity is the most obvious and important user experience, as the user will directly come to a conclusion about whether thorough cleaning is achieved. The dry-cleaning module may also include a side brush having a rotation shaft angled relative to the ground for moving debris to a region of the rolling brush of the cleaning module 150.

Figure 5:
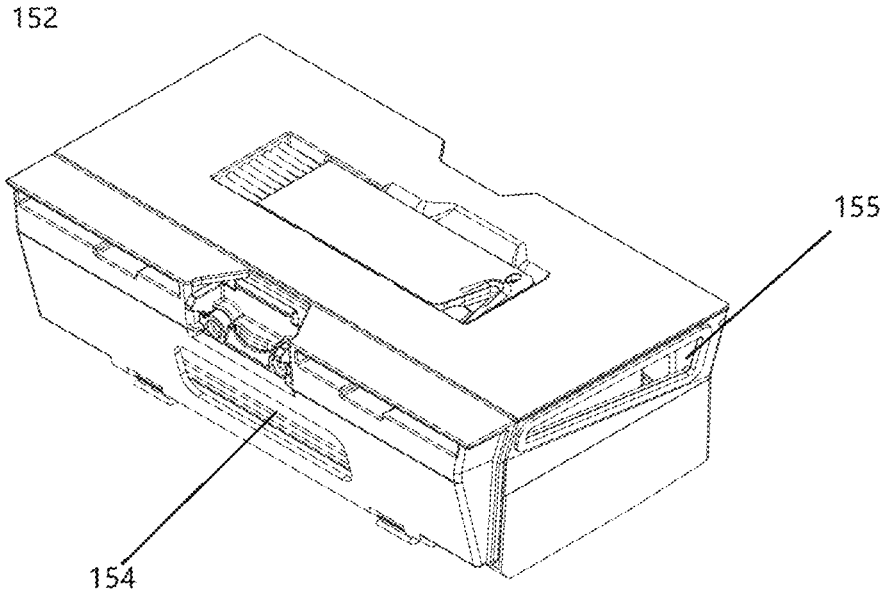
FIG. 5 is an oblique view of a dust box according to an embodiment of the present invention.
Figure 6:
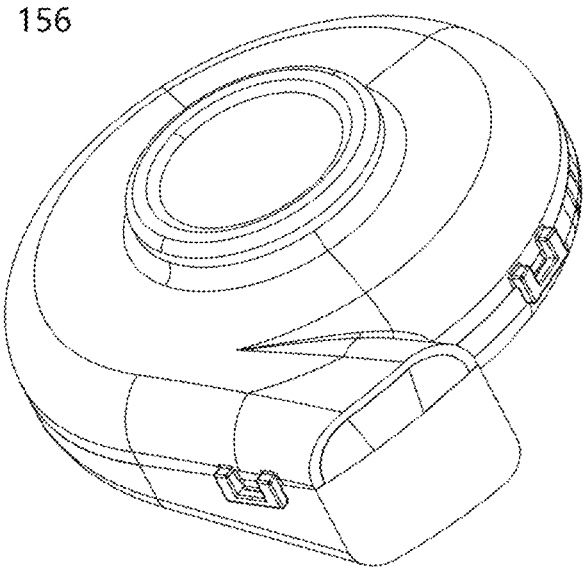
FIG. 6 is an oblique view of a blower according to an embodiment of the present invention.
Figure 7:
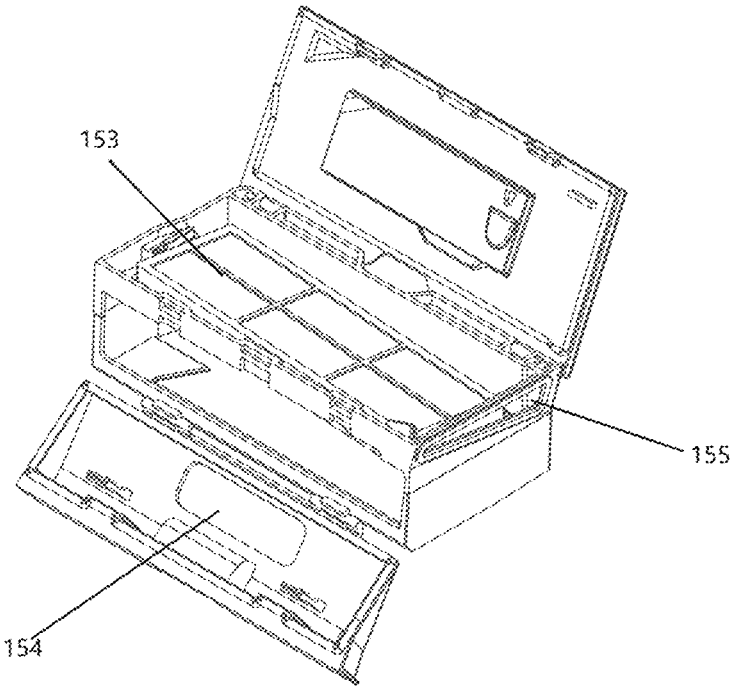
FIG. 7 is a schematic diagram of a dust box in an open state according to an embodiment of the present invention.
Figure 8:
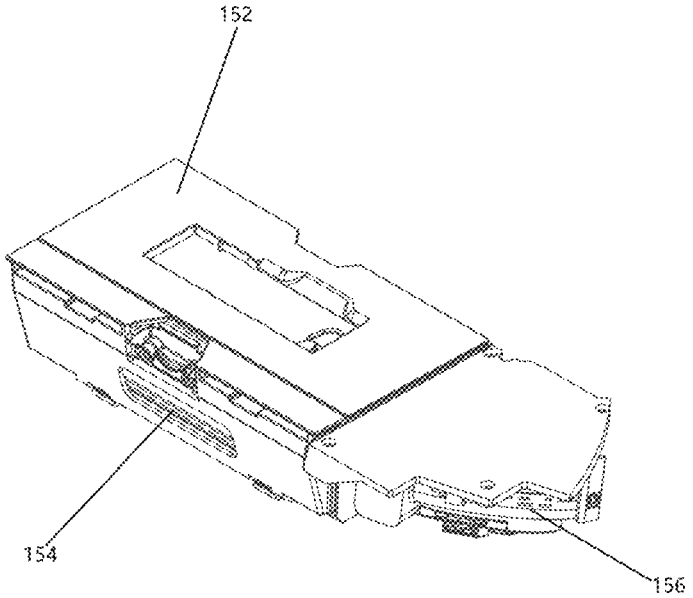
FIG. 8 is a schematic diagram of a dust box and a blower in an assembled state according to an embodiment of the present invention.

FIG. 5 is a schematic structural diagram of a dust box 152 in the dry-cleaning module. FIG. 6 is a schematic structural diagram of a blower 156 in the dry-cleaning module, FIG. 7 is a schematic diagram of the dust box 152 in an open state, and FIG. 8 is a schematic diagram of the dust box and the blower in an assembled state.

The rolling brush having a certain interference with the ground sweeps up garbage on the ground and rolls up the garbage to the front of the dust-sucking port 154 between the rolling brush and the dust box 152. Then, the garbage is sucked into the dust box 152 by the air which has a sucking force, is generated by the blower 156, and passes through the dust box 152. The garbage is isolated by a filtering mesh 153 on an inner side of the dust box 152 close to the dust-sucking port 154. The filtering mesh 153 completely isolates the dust-sucking port from the air outlet, and the filtered air enters the blower 156 through the air outlet 155.

Typically, the dust-sucking port 154 of the dust box 152 is located in front of the automatic cleaning apparatus, the air outlet 155 is located on a side of the dust box 152, and an air sucking port of the blower 156 is docked with the air outlet of the dust box.

A front panel of the dust box 152 may be opened for removing garbage from the dust box 152.

The filtering mesh 153 is detachably connected to a body of the dust box 152 to facilitate disassembly, assembly, and cleaning.

Figure 9:
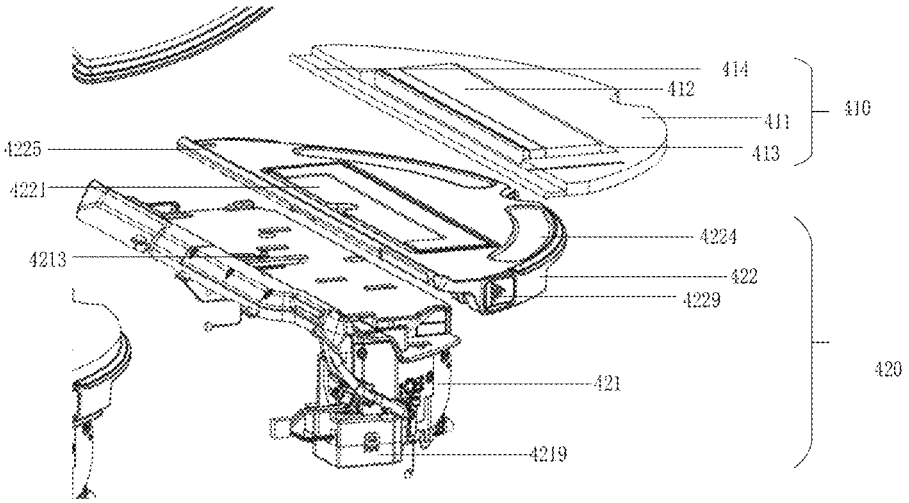
FIG. 9 is an exploded view of an automatic cleaning apparatus according to an embodiment of the present invention.
Figure 10:
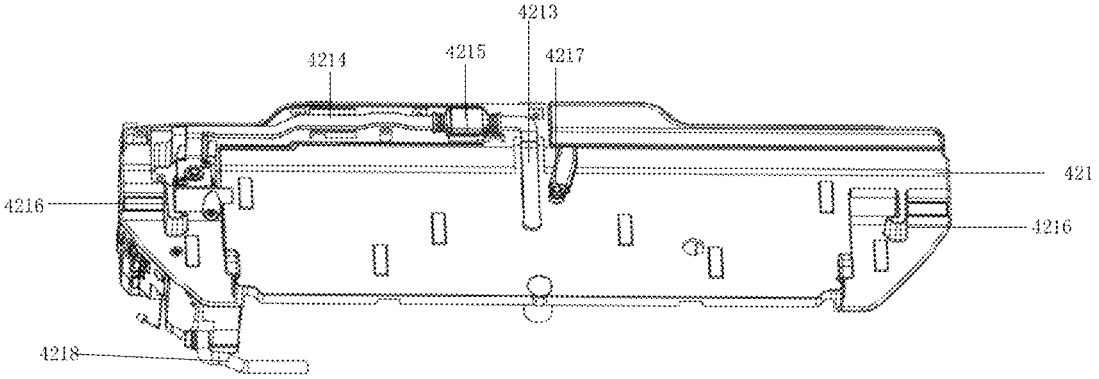
FIG. 10 is a structural diagram of a support platform of an automatic cleaning apparatus according to an embodiment of the present invention.
Figure 11:
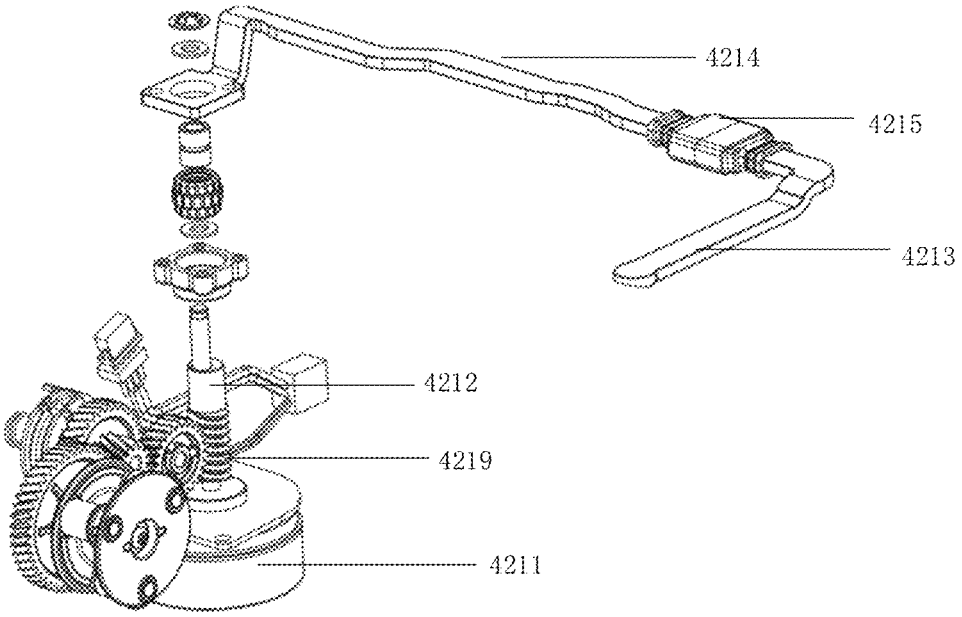
FIG. 11 is a structural diagram of a vibrating member of an automatic cleaning apparatus according to an embodiment of the present invention.

According to a specific embodiment of the present invention, as shown in FIGS. 9-11, the wet-cleaning module 400 according to the present invention is configured to clean at least a part of an operation surface by means of wet cleaning. The wet-cleaning module 400 includes a cleaning head 410 and a driving unit 420. The cleaning head 410 is used for cleaning at least a part of the operation surface, and the driving unit 420 is used for driving the cleaning head 410 to substantially reciprocate along a target surface, the target surface being a part of the operation surface. The cleaning head 410 reciprocates along a surface to be cleaned, and a surface of the cleaning head 410 in contact with the surface to be cleaned is provided with a cleaning cloth or a cleaning plate, which generates a high-frequency friction with the surface to be cleaned through a reciprocating motion thereof, thereby removing stains on the surface to be cleaned.

The higher the friction frequency is, the larger the number of friction times per unit the time is. A high-frequency reciprocating motion, also called a reciprocating vibration, has a cleaning ability much higher than an ordinary reciprocating motion, such as rotational friction cleaning. Optionally, when the friction frequency approaches that of a sound wave, the cleaning effect will be much higher than that of the rotational friction cleaning of dozens of revolutions per minute. On the other hand, tufts on the surface of the cleaning head extend together in the same direction under the shaking of high-frequency vibration, and thus the overall cleaning effect is more uniform. By contrast, only downward pressure is applied to increase the frictional force in the case of low-frequency rotation to improve the cleaning effect, and only applying the downward pressure does not cause the tufts to extend in the same direction. Therefore, in terms of effect, water marks on the operation surface that is cleaned under the high-frequency vibration are more uniform, and no chaotic water stains will be left.

The reciprocating motion may be a repeated motion along any one or more directions within the operation surface or may be a vibrating motion perpendicular to the operation surface, which is not strictly limited. Optionally, the direction of the reciprocating motion of the cleaning module is substantially perpendicular to the traveling direction of the automatic cleaning apparatus, because the direction of the reciprocating motion being parallel to the traveling direction of the automatic cleaning apparatus may cause the automatic cleaning apparatus itself, which is traveling, to be unstable. The reason is that thrust and resistance in the traveling direction make it easy for the driving wheel to skid, and the effect of a skid is more obvious when the wet-cleaning module is included, as the wetness of the operation surface increases the possibility of a skid. The skid not only affects the smooth traveling for cleaning of the automatic cleaning apparatus, but also causes the sensors such as an odometer and a gyroscope to inaccurately perform distance measurements, thereby resulting in the inability of the navigation type of automatic cleaning apparatus to accurately locate and generate a map. In the case of frequent skids, the effect on SLAM cannot be ignored. Therefore, it is necessary to avoid the skid of the automatic cleaning apparatus as far as possible. In addition to skid, a motion component of the cleaning head in the traveling direction of the automatic cleaning apparatus causes the automatic cleaning apparatus to be constantly pushed forward and backward when the automatic cleaning apparatus travels, thereby rendering the automatic cleaning apparatus to travel unstably.

According to an alternative embodiment of the present invention, as shown in FIG. 9, the driving unit 420 includes a driving platform 421, connected to a bottom surface of the mobile platform 100 for providing a driving force; and a support platform 422, detachably connected to the driving platform 421 for supporting the cleaning head 410 and being able to lift and lower under the driving of the driving platform 421.

As an alternative embodiment of the present invention, a lifting and lowering module is provided between the cleaning module 150 and the mobile platform 100, so that the cleaning module 150 may better contact the surface to be cleaned, or different cleaning strategies may be used for surfaces made of different materials to be cleaned.

Optionally, the dry-cleaning module 151 may be connected to the mobile platform 100 through a passive lifting and lowering module. When the cleaning apparatus encounters an obstacle, the dry-cleaning module 151 may cross over the obstacle more easily through the lifting and lowering module.

Optionally, the wet-cleaning module 400 may be connected to the mobile platform 100 through an active lifting and lowering module. When the wet-cleaning module 400 does not work temporarily or encounters a surface to be cleaned that cannot be cleaned by the wet-cleaning module 400, the wet-cleaning module 400 is lifted by the active lifting and lowering module and separated from the surface to be cleaned. Thus, the cleaning means may be changed.

As shown in FIGS. 10-11, the driving platform 421 includes a motor 4211, disposed on a side of the driving platform 421 close to the mobile platform 100 and used for outputting power by a motor output shaft; a driving wheel 4212, connected to the motor output shaft and having an asymmetric structure, and a vibrating member 4213, disposed on a side of the driving platform 421 opposite to the motor 4211 and connected to the driving wheel 4212, and configured to reciprocate under the asymmetrical rotation of the driving wheel 4212.

The driving platform 421 may further include a gear mechanism. The gear mechanism may connect the motor 4211 and the driving wheel 4212. The motor 4211 may directly drive the driving wheel 4212 to swivel or may indirectly drive the driving wheel 4212 to swivel through the gear mechanism. Those skilled in the art can understand that the gear mechanism may be one gear or may be a gear set composed of a plurality of gears.

The motor 4211 simultaneously transmits, by a power transmission device, power to the cleaning head 410, the driving platform 421, the support platform 422, a water delivery mechanism, a water tank, and the like. The energy system 160 provides power and energy for the motor 4211 and is entirely controlled by the control system 130. The power transmission device may be a gear drive, a chain drive, a belt drive, a worm gear or the like.

The motor 4211 has a forward output mode and a reverse output mode. In the forward output mode, the motor 4211 rotates forward, and in the reverse output mode, the motor 4211 rotates reversely. In the forward output mode of the motor 4211, the motor 4211 may simultaneously drive, by the power transmission device, the vibrating member 4213 of the driving platform in the wet-cleaning module 400 to substantially reciprocate and the water delivery mechanism to move synchronously. In the reverse output mode of the motor 4211, the motor 4211 drives the driving platform 421 to lift and lower by the power transmission device.

Further, the driving platform 421 also includes a connection rod 4214, extending along an edge of the driving platform 421 and used for connecting the driving wheel 4212 and the vibrating member 4213, so that the vibrating member 4213 extends to a preset position. An extending direction of the vibrating member 4213 is perpendicular to the connection rod 4214, so that the reciprocating motion direction of the vibrating member 4213 is substantially perpendicular to the traveling direction of the automatic cleaning apparatus.

Figure 15:
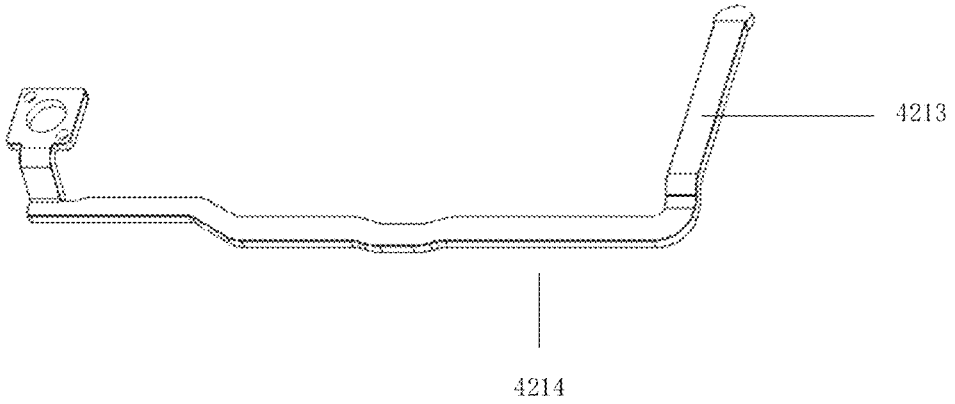
FIG. 15 is a structural diagram of a vibrating member according to an embodiment of the present invention.

The motor 4211 is connected to the driving wheel 4212, the vibrating member 4213, the connection rod 4214 and a vibration buffer device 4215 through the power transmission device. The vibrating member 4213 and the connection rod 4214 constitute an approximate L-shaped structure, as shown in FIG. 15. The vibrating member 4213 reciprocates under the driving of the connection rod 4214. The vibration buffer device 4215 has the effect of damping and reducing the shaking of the motion driven by the driving wheel 4212, so that the vibrating member 4213 may vibrate smoothly within the range of motion provided by the support platform 422. Optionally, the vibration buffer device 4215 is made of a soft material, optionally a rubber structure, and the vibration buffer device 4215 is sleeved on the connection rod 4214. On the other hand, the vibration buffer device 4215 may also protect the vibrating member 4213 from being damaged due to collision with the driving platform 421, and thus may affect the reciprocating motion of the vibrating member 4213. The movable components and the fixed components of the driving platform 421 are constrained from moving through connections with less elasticity in the traveling direction of the automatic cleaning apparatus and are connected flexibly and allowed to move in the direction substantially perpendicular to the traveling direction of the automatic cleaning apparatus, that is, in the vibrating direction of the vibrating member 4213. The above movement restrictions make the vibrating member 4213 not exactly reciprocate, but substantially reciprocate. When the wet-cleaning module 400 is activated, the motor 4211 starts to rotate forward, the motor 4211 drives, through the driving wheel 4212, the connection rod 4214 to reciprocate along the surface of the driving platform 421, and at the same time, the vibration buffer device 4215 drives the vibrating member 4213 to substantially reciprocate along the surface of the driving platform 421. The vibrating member 4213 drives a cleaning substrate 4221 to substantially reciprocate along the surface of the support platform 422, and the cleaning substrate 4221 drives a movable region 412 to substantially reciprocate along the surface to be cleaned. At this point, a clean water pump renders clean water to flow out from a clean water tank, the clean water is sprinkled on the cleaning head 410 through a water-discharging device 4217, and the cleaning head 410 reciprocates to clean the surface to be cleaned.

The cleaning intensity or efficiency of the automatic cleaning apparatus may also be automatically and dynamically adjusted according to an operation environment of the automatic cleaning apparatus. For example, the automatic cleaning apparatus may achieve dynamical adjustment according to physical information of the surface to be cleaned detected by the sensing system 120. For example, the sensing system 120 may detect the flatness of the surface to be cleaned, a material of the surface to be cleaned, whether there is oil and dust, and other information, and transmit the information to the control system 130 of the automatic cleaning apparatus. Accordingly, the control system 130 may instruct the automatic cleaning apparatus to automatically and dynamically adjust a rotational speed of the motor and a transmission ratio of the power transmission device according to the operation environment of the automatic cleaning apparatus, and thus to adjust a preset reciprocating period of the reciprocating motion of the cleaning head 410.

For example, when the automatic cleaning apparatus operates on a flat ground, the preset reciprocating period may be automatically and dynamically adjusted to be longer, and a water volume of the water pump may be automatically and dynamically adjusted to be smaller. When the automatic cleaning apparatus operates on a less flat ground, the preset reciprocating period may be automatically and dynamically adjusted to be shorter, and the water volume of the pump may be automatically and dynamically adjusted to be larger. The reason is that it is easier to clean the flat ground than the less flat ground, and thus the reciprocating motion of the cleaning head 410 at a higher speed (i.e., higher frequency) and a larger water volume are needed for cleaning an uneven ground.

For another example, when the automatic cleaning apparatus operates on a table, the preset reciprocating period may be automatically and dynamically adjusted to be longer, and the water volume of the water pump may be automatically and dynamically adjusted to be smaller. When the automatic cleaning apparatus 100 operates on the ground, the preset reciprocating period may be automatically and dynamically adjusted to be shorter, and the water volume of the water pump may be automatically and dynamically adjusted to be larger. The reason is that the table has less dust and oil compared to the ground, and the material of the table makes it easier to clean. Thus, only a fewer number of reciprocating motions of the cleaning head 410 and a relatively smaller water volume of the water pump are needed for cleaning the table.

Figure 16:
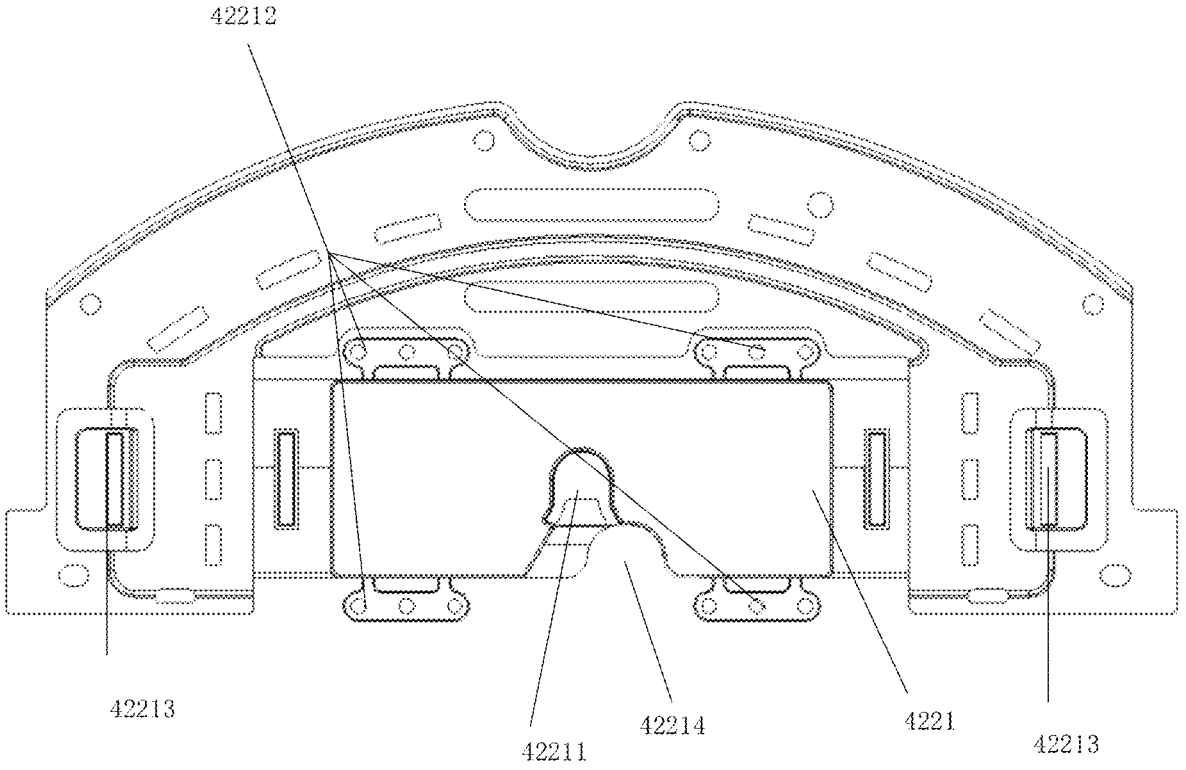
FIG. 16 is a schematic structural diagram of a cleaning substrate as assembled according to an embodiment of the present invention.

As an alternative embodiment of the present invention, the support platform 422 includes the cleaning substrate 4221 disposed movably on the support platform 422. The cleaning substrate 4221 substantially reciprocates under the vibration of the vibrating member 4213. Optionally, as shown in FIG. 16, the cleaning substrate 4221 includes an assembling notch 42211 disposed at a position in contact with the vibrating member 4213. When the support platform 422 is connected to the driving platform 421, the vibrating member 4213 is assembled to the assembling notch 42211, so that the cleaning substrate 4221 may substantially reciprocate synchronously with the vibrating member 4213. Four first limiting portions 42212 are included for the cleaning substrate 4221 in the traveling direction of the cleaning apparatus. The four first limiting portions 42212 are flexibly connected to the cleaning substrate 4221, but the elastic scaling space is small. Thus, the movement of the cleaning substrate 4221 relative to the support platform 422 in the traveling direction of the cleaning apparatus is limited. Two second limiting portions 42213 are included in the direction of the cleaning substrate 4221 perpendicular to the traveling direction of the cleaning apparatus, and the two second limiting portions 42213 limit a range of reciprocating motion of the cleaning substrate 4221 in the direction perpendicular to the traveling direction of the cleaning apparatus. Furthermore, a water-discharging hole 42214 is provided near the assembling notch 42211 of the cleaning substrate 4221, so that water flowing out from the water-discharging device 4217 flows to the cleaning head 410 via the water-discharging hole. The cleaning substrate 4221 substantially reciprocates under the influences of the limiting portions and the vibration buffer device. The cleaning substrate 4221 is located at a part of the support platform 422, and a vibration frequency may be made higher by means of local vibration, such as reaching a frequency range of the sound wave. The movable components and the fixed components of the driving platform 421 are restricted from moving through connections with less elasticity in the traveling direction of the automatic cleaning apparatus and are connected flexibly and allowed to move in the direction substantially perpendicular to the traveling direction of the automatic cleaning apparatus, that is, in the vibrating direction of the vibrating member 4213.

Figure 12:
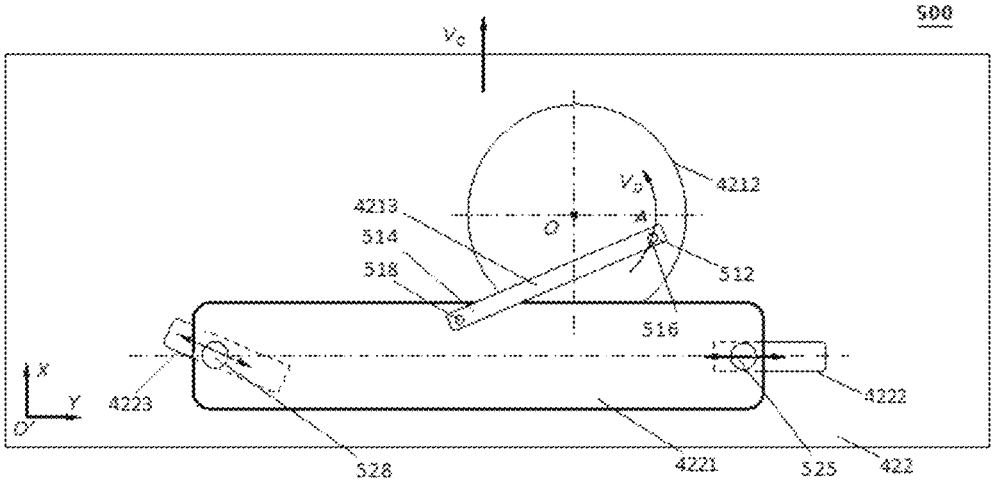
FIG. 12 is a schematic diagram of a cleaning head driving mechanism based on a crank slider mechanism according to another embodiment of the present invention.

FIG. 12 shows another cleaning head driving mechanism based on a crank slider mechanism according to various embodiments of the present application. The driving mechanism 500 may be applied to the driving platform 421. The driving mechanism 500 includes a driving wheel 4212, a vibrating member 4213, a cleaning substrate 4221, a sliding slot 4222 (a first sliding slot), and a sliding slot 4223 (a second sliding slot).

The sliding slots 4222 and 4223 are formed in the support platform 422. Both ends of the cleaning substrate 4221 include a slider 525 (a first slider) and a slider 528 (a second slider), respectively. The sliders 525 and 528 are protrusions at both ends of the cleaning substrate 4221. The slider 525 is inserted within the sliding slot 4222 and may slide along the sliding slot 4222. The slider 528 is inserted within the sliding slot 4223 and may slide along the sliding slot 4223. In some embodiments, the sliding slot 4222 and the sliding slot 4223 are on the same line. In some embodiments, the sliding slot 4222 and the sliding slot 4223 are not on the same line. In some embodiments, the sliding slot 4222 and the sliding slot 4223 extend in the same direction. In some embodiments, an extending direction of the sliding slot 4222 and an extending direction of the sliding slot 4223 are the same as that of the cleaning substrate 4221. In some embodiments, the extending direction of the sliding slot 4222 and the extending direction of the sliding slot 4223 are different from that of the cleaning substrate 4221. In some embodiments, the extending direction of the sliding slot 4222 is different from the extending direction of the sliding slot 4223. For example, as shown in FIG. 12, the extending direction of the sliding slot 4222 is the same as that of the cleaning substrate 4221, and the extending direction of the sliding slot 4223 is angled relative to that of the sliding slot 4222.

The vibrating member 4213 includes a swiveling end 512 and a sliding end 514. The swiveling end 512 is connected to the driving wheel 4212 through a first pivot 516, and the sliding end 514 is connected to the cleaning substrate 4221 through a second pivot 518.

A swiveling center of the driving wheel 4212 is a point O, and a pivoting center of the first pivot 516 is a point A. The point O and the point A do not coincide, and the distance between the point O and the point A is a preset distance d.

When the driving wheel 4212 rotates, the point A also swivels along a circular path. Accordingly, the swiveling end 512 follows the point A to swivel along a circular path; and the sliding end 514 drives the cleaning substrate 4221 to slide through the second pivot 518. Accordingly, the slider 525 of the cleaning substrate 4221 reciprocates linearly along the sliding slot 4222; and the slider 528 of the cleaning substrate 4221 reciprocates linearly along the sliding slot 4223. In FIG. 4, a moving speed of the mobile platform 100 is V0, and a moving direction thereof is the target direction. According to some embodiments, when the sliding slot 4223 and the sliding slot 4222 are respectively approximately perpendicular to the direction of the moving speed V0 of the mobile platform 100, an overall displacement of the cleaning substrate 4221 is substantially perpendicular to the target direction. According to some other embodiments, when any one of the sliding slot 4223 and the sliding slot 4222 forms an angle other than 90 degrees with the target direction, the overall displacement of the cleaning substrate 4221 includes both a component perpendicular to the target direction and a component parallel to the target direction.

Further, a vibration buffer device 4215 is included, which is disposed on the connection rod 4214 for reducing vibration in a specific direction. In this embodiment, the vibration buffer device 4215 is used for reducing vibration in the direction of the moving component perpendicular to the target direction of the automatic cleaning apparatus.

Figure 13:
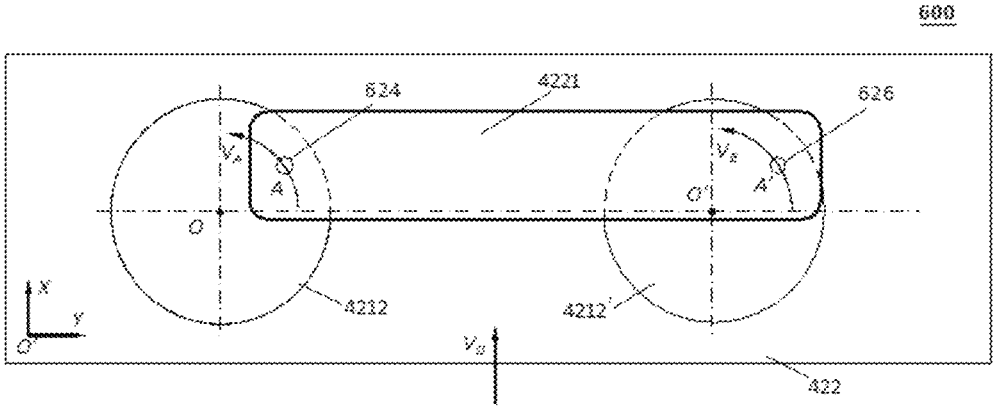
FIG. 13 is a schematic diagram of a cleaning head driving mechanism based on a double-crank mechanism according to another embodiment of the present invention.

FIG. 13 shows another cleaning head driving mechanism 600 based on a double-crank mechanism according to various embodiments of the present application. The driving mechanism 600 may be applied to the driving platform 421. The driving mechanism 600 includes a driving wheel 4212 (a first driving wheel), a driving wheel 4212 (a second driving wheel), and a cleaning substrate 4221.

The cleaning substrate 4221 has two ends, a first end thereof is connected to the driving wheel 4212 through a pivot 624 (a first pivot), and a second end thereof is connected to the driving wheel 4212' through a pivot 626 (a second pivot). A swiveling center of the driving wheel 4212 is a point O. and a pivoting center of the pivot 624 is a point A. The point O and the point A do not coincide, and the distance between the point O and the point A is a preset distance d. A swiveling center of the driving wheel 4212 is a point O', and a pivoting center of the pivot 626 is point A'. The point O' and the point A' do not coincide, and the distance between the point O' and the point A' is a preset distance d. In some embodiments, the point A, the point A', the point O, and the point O' are on the same plane.

Therefore, the driving wheel 4212, the driving wheel 4212', and the cleaning substrate 4221 may form the double-crank mechanism (or a parallelogram mechanism), where the cleaning substrate 4221 acts as a coupling lever, and the driving wheels 4212 and 4212' act as two cranks.

Further, a vibration buffer device 4215 is included, which is disposed on the connection rod 4214 for reducing vibration in a specific direction. In this embodiment, the vibration buffer device 4215 is used for reducing vibration in the direction of the moving component perpendicular to the target direction of the automatic cleaning apparatus.

Figure 14:
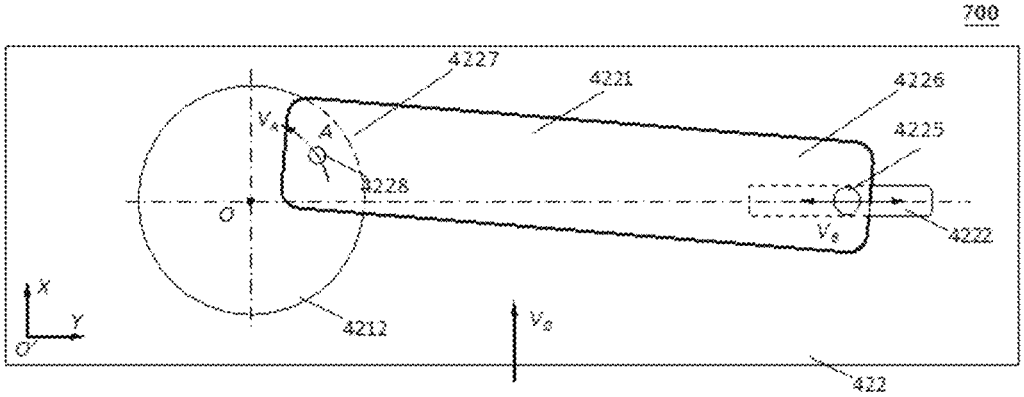
FIG. 14 is a schematic diagram of a cleaning head driving mechanism based on a crank mechanism according to another embodiment of the present invention.

FIG. 14 shows a driving mechanism 700 based on a crank slider mechanism according to various embodiments of the present application. The driving mechanism 700 may be applied to the driving platform 421. The driving mechanism 700 includes a driving wheel 4212, a cleaning substrate 4221, and a sliding slot 4222.

The sliding slot 4222 is formed in the support platform 422. The cleaning substrate 4221 includes a swiveling end 4227 and a sliding end 4226. The swiveling end 4227 is connected to the driving wheel 4212 through a pivot 4228. A swiveling center of the driving wheel 4212 is a point O, and a pivoting center of the pivot 4228 of the swiveling end is a point A. The point O and the point A do not coincide, and the distance between the point O and the point A is a preset distance d. The sliding end 4226 includes a slider 4225. The slider 4225 is a protrusion on the sliding end 4226. The slider 4225 is inserted within the sliding slot 4222 and may slide along the sliding slot 4222. Therefore, the driving wheel 4212, the cleaning substrate 4221, the slider 4225, and the sliding slot 4222 constitute the crank slider mechanism.

When the driving wheel 4212 rotates, the point A swivels along a circular path. Accordingly, the swiveling end 4227 of the cleaning substrate 4221 follows the point A to swivel along a circular path; and the slider 4225 also slides in the sliding slot 4222 to reciprocate linearly. As a result, the cleaning substrate 4221 starts to reciprocate. According to some embodiments, the sliding slot 4222 is approximately perpendicular to a direction of the target direction of a moving speed of the mobile platform. Therefore, the linear motion of the sliding end 4226 includes a component perpendicular to the target direction, and the circular swiveling motion of the swiveling end 4227 includes both a component perpendicular to the target direction and a component parallel to the target direction.

In FIG. 14, the moving speed of the mobile platform is V0, and a moving direction thereof is the target direction; and the sliding slot 4222 is approximately perpendicular to the target direction. At this point, the entire reciprocating motion of the cleaning substrate 4221 includes both a movement component parallel to the target direction of the automatic cleaning apparatus and a movement component perpendicular to the target direction of the automatic cleaning apparatus.

Further, the support platform 422 further includes an elastic detaching button 4229, disposed on at least one side of the support platform 422 for detachably connecting the support platform 422 to a pawl 4216 of the driving platform 421, so that the support platform 422 is detachably and mechanically fixed on the driving platform 421, and the support platform 422 itself is fixed relative to the driving platform and the automatic cleaning apparatus; and at least one assembling region 4224, disposed on the support platform 422 for assembling the cleaning head 410. The assembling region 4224 may be formed of an adhesive material with an adhesive layer.

As an alternative embodiment of the present invention, as shown in FIG. 9, the cleaning head 410 includes a movable region 412, connected to the cleaning substrate 4221 and configured to substantially reciprocate along a surface to be cleaned under the driving of the cleaning substrate 4221. The movable region 412 is disposed at a substantially central position of the cleaning head 410.

Optionally, an adhesive layer is provided on a side of the movable region 412 connected to the cleaning substrate 4221, and the movable region 412 is connected to the cleaning substrate 4221 through the adhesive layer.

Optionally, the cleaning head 410 further includes a fixed region 411, connected to a bottom of the support platform 422 through the at least one assembling region 4224. The fixed region 411 cleans at least a part of the operation surface along with the movement of the support platform 422.

Further, the cleaning head 410 further includes a flexible connection portion 413, disposed between the fixed region 411 and the movable region 412 for connecting the fixed region 411 and the movable region 412. The cleaning head 410 further includes a sliding buckle 414, extending along an edge of the cleaning head 410 and detachably mounted at an engagement position 4225 of the support platform 422.

In this embodiment, as shown in FIG. 9, the cleaning head 410 may be made of a material having a certain elasticity, and the cleaning head 410 is fixed on a surface of the support platform 422 through an adhesive layer so as to reciprocate. When operating, the cleaning head 410 is always in contact with the surface to be cleaned.

The water delivery mechanism includes the water-discharging device 4217. The water-discharging device 4217 may be directly or indirectly connected with a cleaning liquid outlet of a water tank (not shown), that is, a liquid discharging port of the clean water tank. The cleaning liquid may flow toward the water-discharging device 4217 via the cleaning liquid outlet of the water tank and may be evenly coated on the surface to be cleaned through the water-discharging device. A connection member (not shown in the figures) may be provided on the water-discharging device, and the water-discharging device is connected to the cleaning liquid outlet of the water tank through the connection member. The water-discharging device is provided with a distribution port. The distribution port may be a continuous opening, or a combination of several discontinuous small openings. Several nozzles may be provided at the distribution port. The cleaning liquid flows toward the distribution port via the cleaning liquid outlet of the water tank and the connection member of the water-discharging device and is evenly coated on the operation surface via the distribution port.

The water delivery mechanism may further include a clean water pump 4219 and/or a clean water pump pipe 4218. The clean water pump 4219 may be in communication with the cleaning liquid outlet of the water tank directly, or in communication with the cleaning liquid outlet of the water tank through the clean water pump pipe 4218.

The clean water pump 4219 may be connected to the connection member of the water-discharging device and may be configured to pump the cleaning fluid from the water tank to the water-discharging device. The clean water pump may be a gear pump, a vane pump, a plunger pump, a peristaltic pump, and the like.

The water delivery mechanism pumps the cleaning liquid out of the clean water tank through the clean water pump 4219 and the clean water pump pipe 4218 and transports the cleaning liquid to the water-discharging device. The water-discharging device 4217 may be a spray head, a drip hole, a wet cloth, and the like, and may spread water evenly on the cleaning head so as to wet the cleaning head and the surface to be cleaned. Stains on the wetted surface to be cleaned may be cleaned more easily. In the wet-cleaning module 400, the power or flow rate of the clean water pump may be adjusted.

Figure 17:
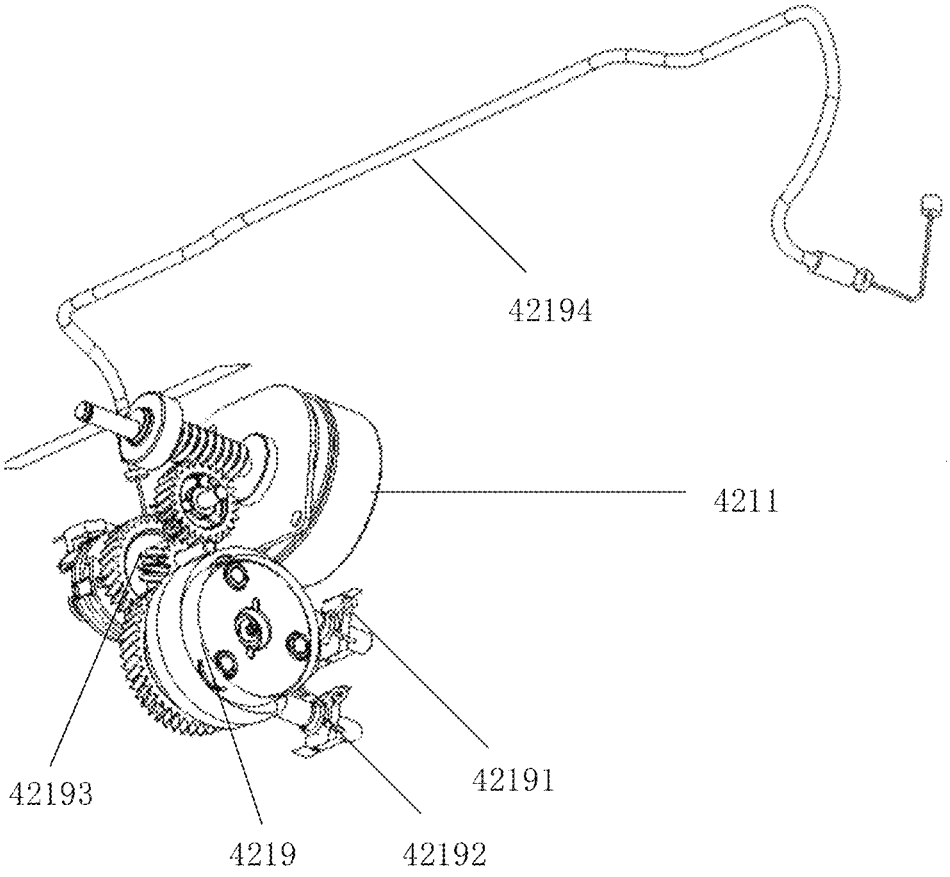
FIG. 17 is a structural diagram of a clean water pump driven by a motor according to an embodiment of the present invention.

Further, as shown in FIG. 17, the motor 4211 drives the clean water pump 4219 to wriggle through a gear set 42193. Through the wriggle of the clean water pump 4219, the clean water enters from a water inlet 42191, flows out from a water outlet 42192, and is then transported to the water-discharging device 4217 through the clean water pump pipe 4218, and the water flowing out from the water-discharging device 4217 flows to the cleaning head 410 via the water-discharging hole.

Figure 18:
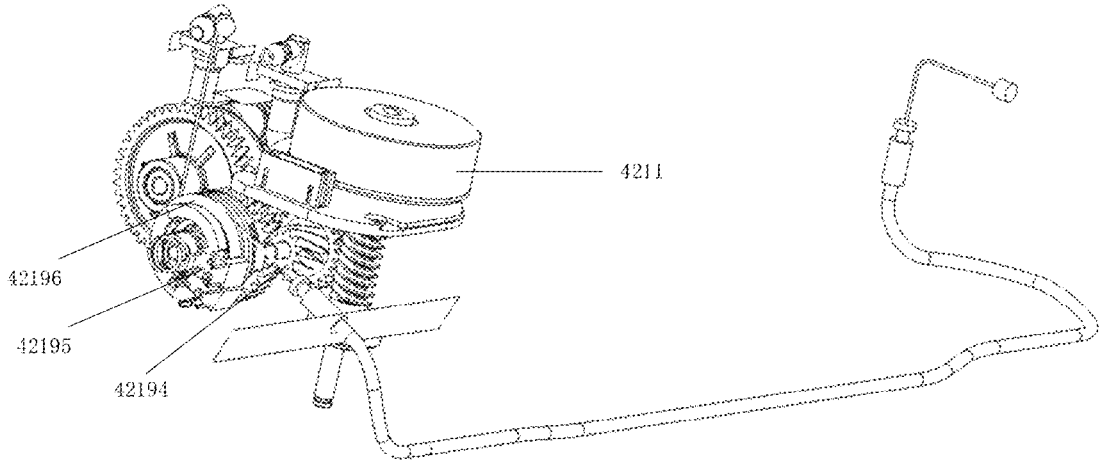
FIG. 18 is a structural diagram of a lifting and lowering module driven by a motor according to an embodiment of the present invention.

Further, as shown in FIG. 18, the motor 4211 drives a cable gear 42196 to rotate through the gear set 42193. A cable 42194 is wound on the cable gear 42196. The cable 42194 is wound and suspended on the driving platform 421. The cable gear 42196 pulls the cable 42196 to rise and drop so as to lift and lower the driving platform 421. The cable gear 42196 and the cable 42194 are core components of the lifting and lowering module.

A clutch 42195 is provided on the gear set 42193 and the cable gear 42196. By controlling engagement and disengagement of the clutch 42195, the motor 4211 controls three moving modules for rotating in one direction to drive the vibrating member to vibrate and simultaneously make the clean water pump 4219 supply water, and further for rotating in an opposite direction to drive the lifting and lowering module to rise and drop through the cable 42194. Optionally, the combined design of the gear set realizes the control over different combinations of the three moving modules. For example, rotation in one direction realizes that the clean water pump supplies water, and rotation in the opposite direction realizes the control over rising, dropping, and vibration. Optionally, two motors may also be used to control the three moving modules, but an extra motor will also increase the cost.

Since the cleaning module of the automatic cleaning apparatus includes the dry-cleaning module and the wet-cleaning module, a more comprehensive cleaning function may be provided. Meanwhile, the driving unit and the vibrating region are added to the wet-cleaning module, and thus the cleaning head may reciprocate so as to repeatedly clean the surface to be cleaned. Therefore, in the movement trajectory of a cleaning robot, a region may be cleaned several times when the cleaning robot passes through the region just one time, thereby greatly enhancing the cleaning effect. Especially for regions with more stains, the cleaning effect becomes obvious.

Figure 19:
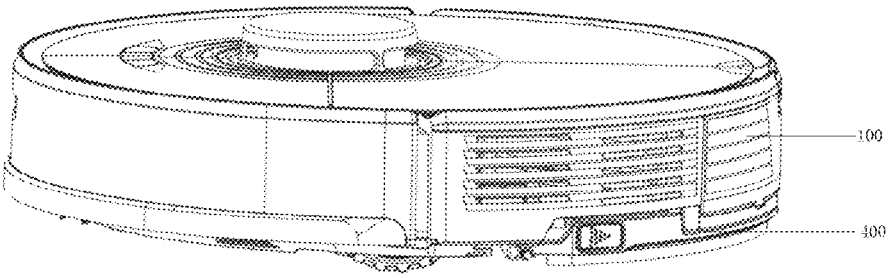
FIG. 19 is a schematic diagram of an automatic cleaning apparatus in a lifted state according to an embodiment of the present invention.
Figure 20:
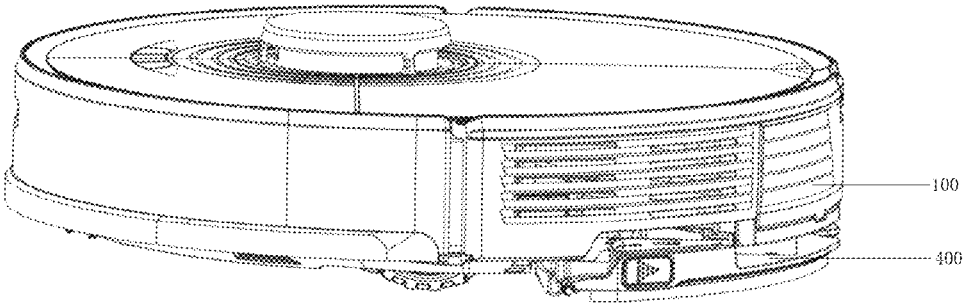
FIG. 20 is a schematic diagram of an automatic cleaning apparatus in a lowered state according to an embodiment of the present invention.

As shown in FIGS. 19-20, the wet-cleaning module 400 is movably connected to the mobile platform 100 through a four-link lifting and lowering structure 500 and is configured to clean at least a part of the operation surface by means of wet cleaning. The four-link lifting and lowering structure 500 is a parallelogram structure and is used to switch the wet-cleaning module 400 between a lifted state and a lowered state. The lifted state is a state in which the wet-cleaning module 400 leaves the operation surface, as shown in FIG. 19. The lowered state is a state in which the wet-cleaning module 400 is fitted to the operation surface, as shown in FIG. 20.

Figure 21:
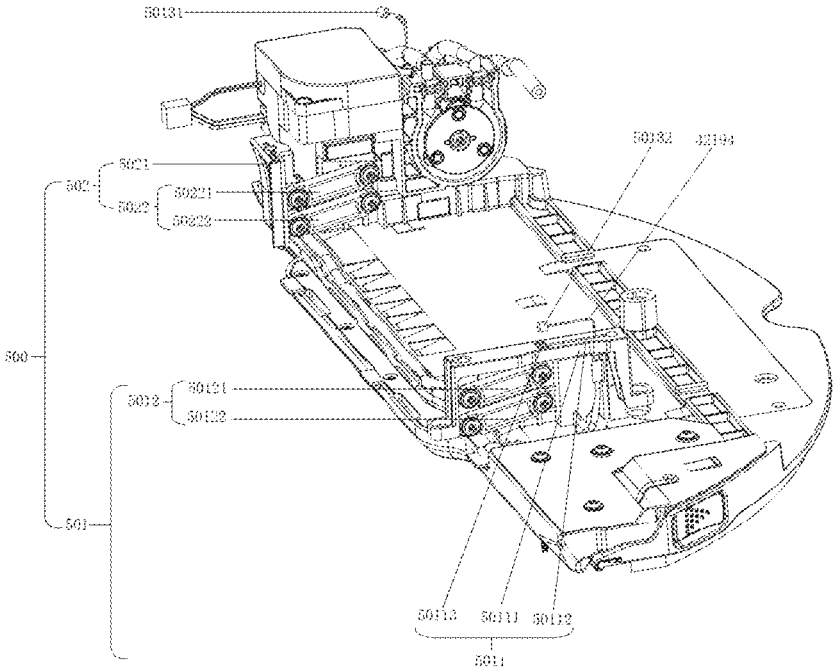
FIG. 21 is a schematic diagram of a four-link lifting and lowering structure in a lifted state according to an embodiment of the present invention.
Figure 22:
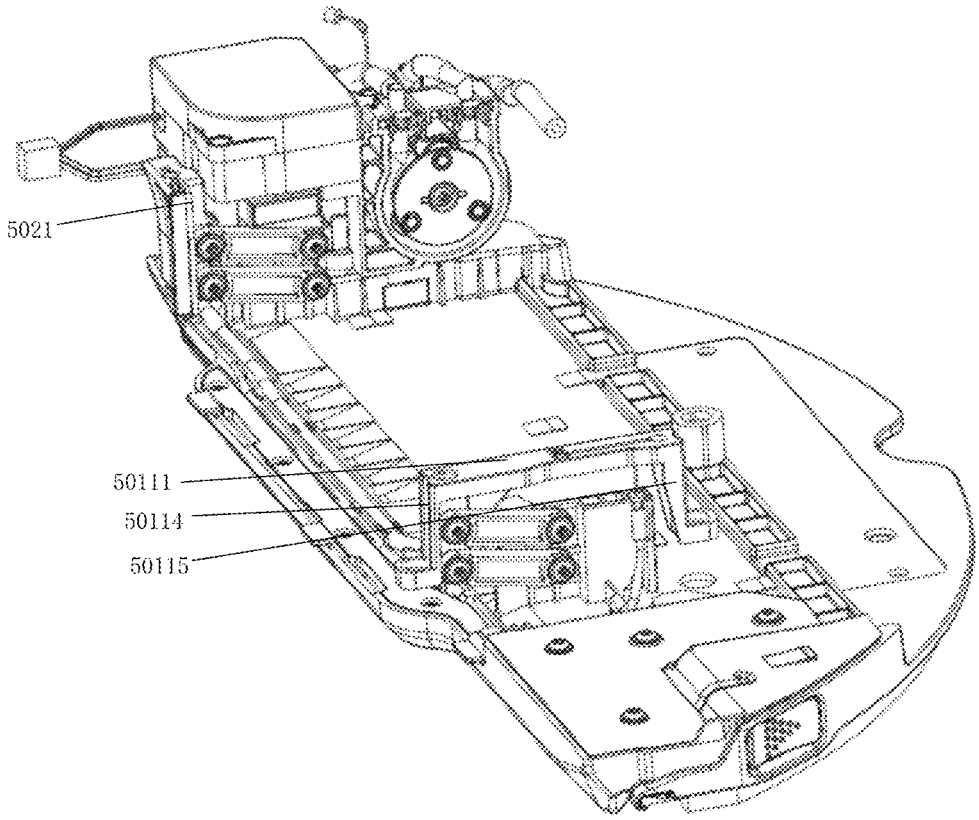
FIG. 22 is a schematic diagram of a four-link lifting and lowering structure in a lowered state according to an embodiment of the present invention.

As shown in FIGS. 21-22, the four-link lifting and lowering structure 500 includes a first connection end 501, for providing active power to switch the wet-cleaning module 400 between the lifted state and the lowered state; and a second connection end 502, disposed opposite to the first connection end 501 and being rotated under the action of the active power. The first connection end 501 and the second connection end 502 are located on two sides of the wet-cleaning module 400, respectively, and the wet-cleaning module 400 is lifted or lowered by stably providing a lifting force or a lowering force.

Specifically, the first connection end 501 includes a first bracket 5011 fixedly connected to a bottom of the mobile platform 100. The first bracket 5011 is roughly shaped like a Chinese character "几" and the first bracket 5011 includes a cross beam 50111, a first longitudinal beam 50114, and a second longitudinal beam 50115. A tail end of each of the first longitudinal beam 50114 and the second longitudinal beam 50115 is fixedly connected to the mobile platform 100 through a bolt, so as to provide a support force when the wet-cleaning module 400 is lifted and lowered.

The first connection end 501 further includes a first connection rod pair 5012. One end of the first connection rod pair 5012 is rotatably connected to the first bracket 5011, and the other end thereof is rotatably connected to the wet-cleaning module 400. The first connection rod pair 5012 may be of a hollowed-out structure, which can reduce the overall weight of the lifting and lowering ends.

Optionally, the first connection rod pair 5012 includes a first connection rod 50121 and a second connection rod 50122, which are arranged in parallel. A first end of each of the first connection rod 50121 and the second connection rod 50122 is rotatably connected to the first longitudinal beam 50114 through a movable stud, and a second end of each of the first connection rod 50121 and the second connection rod 50122 is rotatably connected to the wet-cleaning module 400 through a movable stud. For example, each of two ends of each of the first connection rod 50121 and the second connection rod 50122 is provided with a through hole having a diameter larger than that of the movable stud, so that the movable stud may rotate freely within the through hole, and the movable stud is fixedly connected to the first longitudinal beam 50114 through the through hole. When the motor 4211 provides a pulling force to the first end through the cable, the first ends of the first connection rod 50121 and the second connection rod 50122 simultaneously rotate around the movable studs at the first ends, and the second ends thereof are lifted under the pulling force of the cable, so that the wet-cleaning module 400 is lifted. When the motor 4211 releases the pulling force to the first ends through the cable, the first ends of the first connection rod 50121 and the second connection rod 50122 simultaneously reversely rotate around the movable studs at the first ends, and the second ends thereof are lowered under the action of gravity, so that the wet-cleaning module 400 is lowered.

The lifting and lowering structure 500 further includes the cable 42194 for providing a pulling force to rotate the first connection rod pair 5012 within a preset angle. The cable 42194 includes a cable motor terminal 50131, which is connected to the driving unit 420, for example, wound on and connected to the gear connected to the motor output shaft, and extending and contracting under the rotation of the motor; and a cable bracket terminal 50132, connected to the first bracket 5011. The motor lifts or lowers the second ends of the first connection rod 50121 and the second connection rod 50122 through the cable 42194.

Optionally, the first bracket 5011 further includes a sliding slot 50112, extending along a surface of the cross beam 50111; and a snapping hole 50113, running through the cross beam 50111 and disposed at an extending end of the sliding slot 50112 for accommodating and snapping the cable bracket terminal 50132. The cable 42194 is connected to the first ends of the first connection rod 50121 and the second connection rod 50122 through the sliding slot 50112 and the snapping hole 50113. The sliding slot 50112 may restrict a movement direction of the cable, thereby ensuring the stability during lifting and lowering the module, and the width of the sliding slot should be matched with the thickness of the cable.

As shown in FIGS. 21-22, the second connection end 502 includes a second bracket 5021, fixedly connected to a bottom of the mobile platform 100; and a second connection rod pair 5022, one end of which is rotatably connected to the second bracket 5021, and the other end of which is rotatably connected to the wet-cleaning module 400. The second connection rod pair 5022 rotates with the rotation of the first connection rod pair 5012. The second connection rod pair 5022 may be of a hollowed-out structure, which can reduce the overall weight of the lifting and lowering ends.

Specifically, the second connection rod pair 5022 includes a third connection rod 50221 and a fourth connection rod 50222 which are arranged in parallel. A first end of each of the third connection rod 50221 and the fourth connection rod 50222 is rotatably connected to the second bracket 5021 through a movable stud, and a second end of each of the third connection rod 50221 and the fourth connection rod 50222 is rotatably connected to the wet-cleaning module 400 through a movable stud. For example, each of two ends of each of the third connection rod 50221 and the fourth connection rod 50222 is provided with a through hole having a diameter larger than that of the movable stud, so that the movable stud may rotate freely within the through hole, and the movable stud is fixedly connected to the second bracket 5021 and the wet-cleaning module 400 through the through hole. When the first connection end 501 rotates under the driving of the motor 4211, the first ends of the third connection rod 50221 and the fourth connection rod 50222 simultaneously rotate around the movable studs at the first ends, and the second ends of the third connection rod 50221 and the fourth connection rod 50222 simultaneously rotate around the movable studs at the second ends, so that the wet-cleaning module 400 is lifted. When the first connection end 501 releases the pulling force, the first ends of the third connection rod 50221 and the fourth connection rod 50222 simultaneously reversely rotate around the movable studs at the first ends, and the second ends thereof are lowered under the action of gravity, so that the wet-cleaning module 400 is lowered.

By means of the four-link lifting and lowering structure disposed between the wet-cleaning module and the mobile platform, the wet-cleaning module may be lifted and lowered relative to the mobile platform. When a mopping task is performed, the wet-cleaning module is lowered, so that the wet-cleaning module is in contact with the ground. When the mopping task is completed, the wet-cleaning module is lifted, so that the wet-cleaning module is separated from the ground, thereby avoiding the increased resistance due to the existence of the cleaning module when the cleaning apparatus moves freely on the surface to be cleaned.

In cooperation with a surface medium sensor and other sensors that may detect a surface type of the surface to be cleaned, the lifting and lowering module enables the wet-cleaning module to perform a cleaning operation according to different surfaces to be cleaned. For example, the lifting and lowering module lifts the wet-cleaning module in the case of a carpet surface and lowers the wet-cleaning module in the case of a floor surface, a floor tile surface or the like, for the purpose of cleaning. Thus, a more comprehensive cleaning effect is achieved.

Figure 23:
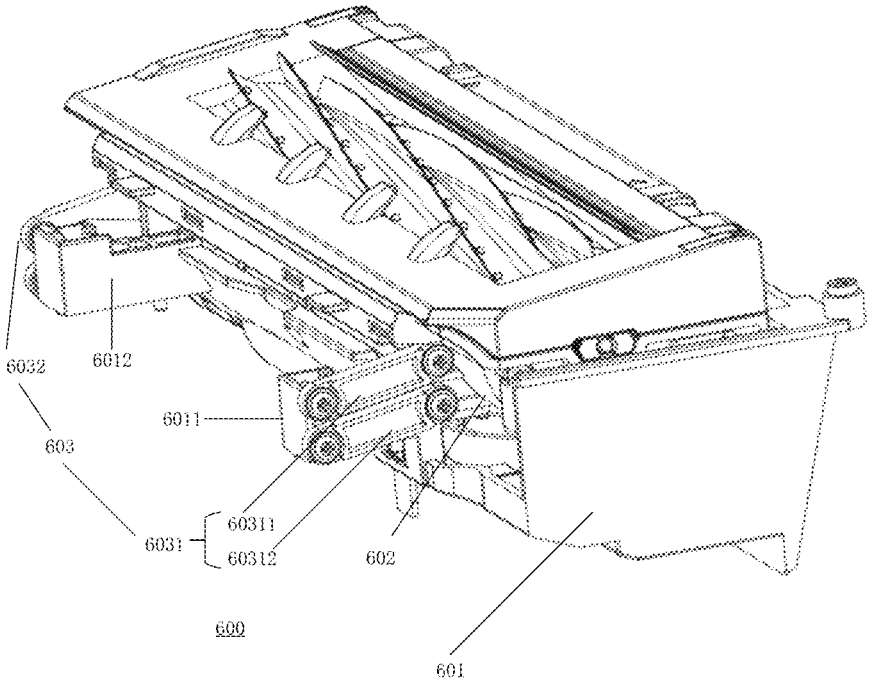
FIG. 23 is a schematic structural diagram of a dry-cleaning module in a lowered state according to an embodiment of the present invention.

As shown in FIG. 23, which is a diagram of the dry-cleaning module 151 in a lifted state, a floating lifting and lowering structure 600 is connected to the dry-cleaning module 151 and configured to enable the dry-cleaning module 151 to move vertically relative to the mobile platform 100 in a passive way. Specifically, the floating lifting and lowering structure 600 is a parallelogram four-link lifting and lowering structure and is configured to passively switch the dry-cleaning module 151 between a lifted state and a lowered state under the action of an external force.

Optionally, the floating lifting and lowering structure 600 includes a first fixed bracket 601 fixedly connected to the mobile platform 100; a second fixed bracket 602 fixedly connected to the dry-cleaning module 151; and a connection rod pair 603, one end of which is rotatably connected to the first fixed bracket 601 through a movable stud, and the other end of which is rotatably connected to the second fixed bracket 602 through a movable stud. The first fixed bracket 601 and the second fixed bracket 602 are connected through a flexible connection member. When encountering an obstacle, the dry-cleaning module 151 is pushed upward, and the first fixed bracket 601 rotates around the connection rod pair 603 and then is retracted upward relative to the second fixed bracket 602, so as to realize the passive lifting. After crossing over the obstacle, the dry-cleaning module 151 falls under the action of gravity and comes into contact with the operation surface, and the cleaning apparatus continues to move forward for the purpose of cleaning. With the parallelogram four-link lifting and lowering structure, the cleaning apparatus can cross over obstacles in a more flexible way and is less liable to damage.

Optionally, the connection rod pair 603 includes a first connection rod pair 6031, one end of which is rotatably connected to a first end of the first fixed bracket 601 through a movable stud, and the other end of which is rotatably connected to a first end of the second fixed bracket 602 through a movable stud; and a second connection rod pair 6032 disposed opposite to the first connection rod pair 6031, one end of which is rotatably connected to a second end of the first fixed bracket 601 through a movable stud, and the other end of which is rotatably connected to a second end of the second fixed bracket 602 through a movable stud. The first connection rod pair 6031 or the second connection rod pair 6032 may be of a hollowed-out structure, which can reduce the overall weight of the lifting and lowering ends.

Optionally, the first connection rod pair 6031 includes a first connection rod 60311 and a second connection rod 60312, which are arranged in parallel. One end of each of the first connection rod 60311 and the second connection rod 60312 is provided with a first shaft hole, and the other end thereof is provided with a second shaft hole. The movable studs rotatably fix the first connection rod 60311 and the second connection rod 60312 to the first end of the first fixed bracket 601 through the first shaft holes. The movable studs rotatably fix the first connection rod 60311 and the second connection rod 60312 to the first end of the second fixed bracket 602 through the second shaft holes. For example, each of two ends of each of the first connection rod 60311 and the second connection rod 60312 is provided with a snapping hole (not shown) having a diameter larger than that of the movable stud, so that the movable stud may rotate freely within the snapping hole, and the movable stud is fixedly connected to the first fixed bracket 601 through the snapping hole. When encountering a raised obstacle, the dry-cleaning module 151 is pushed upward under the action of the obstacle, the first ends of the first connection rod 60311 and the second connection rod 60312 simultaneously rotate around the movable studs at the first ends, and the second ends of the first connection rod 60311 and the second connection rod 60312 simultaneously rotate around the movable studs at the second ends, so that the dry-cleaning module 151 is lifted. When crossing over the obstacle, the dry-cleaning module 151 falls under the action of gravity and comes into contact with the operation surface.

Figure 24:
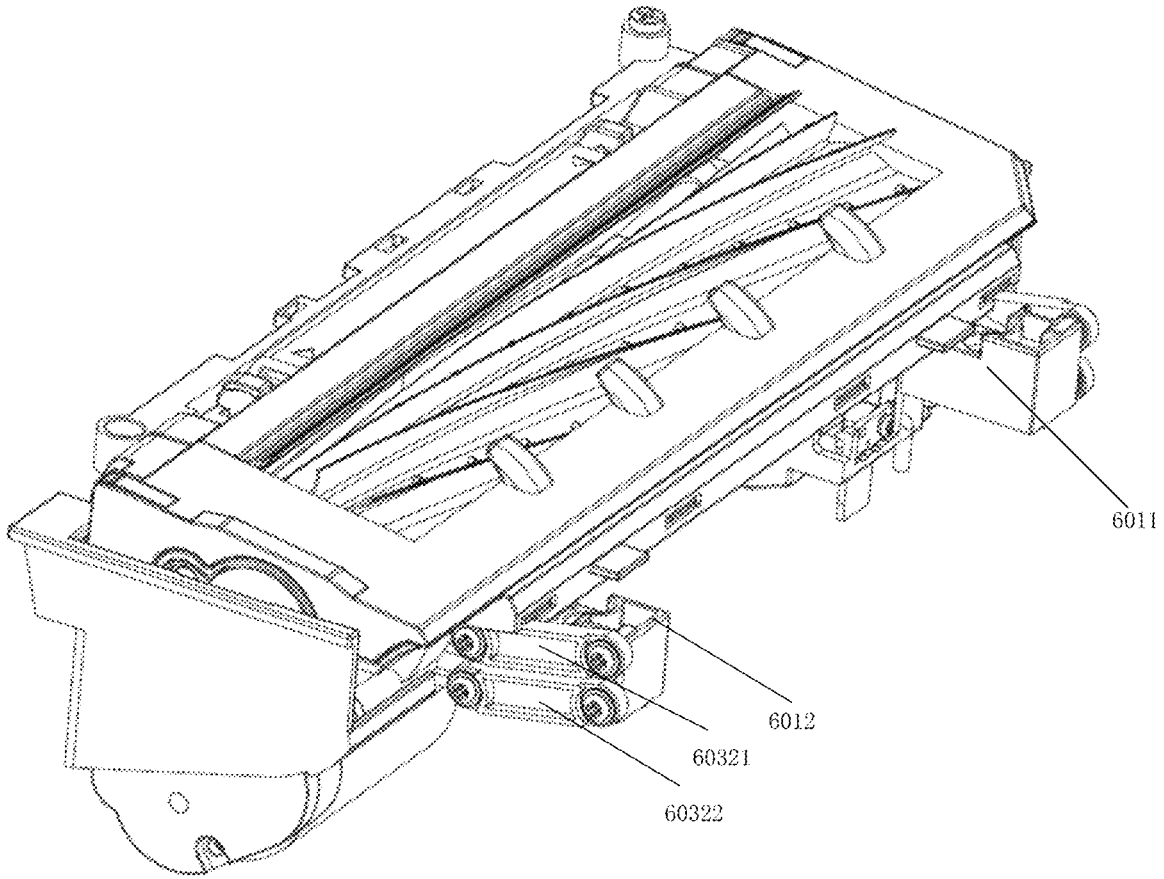
FIG. 24 is a schematic structural diagram of a dry-cleaning module in a lifted state according to an embodiment of the present invention.

Optionally, as shown in FIG. 24, which is a diagram of the dry-cleaning module 151 in a lifted state, the second connection rod pair 6032 includes a third connection rod 60321 and a fourth connection rod 60322, which are arranged in parallel. One end of each of the third connection rod 60321 and the fourth connection rod 60322 is provided with a third shaft hole, and the other end thereof is provided with a fourth shaft hole. The movable studs rotatably fix the third connection rod 60321 and the fourth connection rod 60322 to the second end of the first fixed bracket 601 through the third shaft holes. The movable studs rotatably fix the third connection rod 60321 and the fourth connection rod 60322 to the second end of the second fixed bracket 602 through the fourth shaft holes. For example, each of two ends of each of the third connection rod 60321 and the fourth connection rod 60322 is provided with a snapping hole (not shown) having a diameter larger than that of the movable stud, so that the movable stud may rotate freely within the snapping hole, and the movable stud is fixedly connected to the first fixed bracket 601 through the snapping hole. When encountering a raised obstacle, the dry-cleaning module 151 is pushed upward under the action of the obstacle, the first ends of the third connection rod 60321 and the fourth connection rod 60322 simultaneously rotate around the movable studs at the first ends, and the second ends of the third connection rod 60321 and the fourth connection rod 60322 simultaneously rotate around the movable studs at the second ends, so that the dry-cleaning module 151 is lifted. When crossing over the obstacle, the dry-cleaning module 151 falls under the action of gravity and comes into contact with the operation surface.

As an alternative embodiment, the first fixed bracket 601 includes a first fixed portion 6011, protruding from the first fixed bracket 601 and extending laterally outward for carrying the first connection rod pair 6031; and a second fixed portion 6012, disposed symmetrically with the first fixed portion 6011 for carrying the second connection rod pair 6032. The first fixed portion 6011 and the second fixed portion 6012 are used to support the connection rod pairs in a protruding way, so that the connection rod pairs may rotate freely, thereby ensuring the free lifting and lowering of the dry-cleaning module 151.

Optionally, the floating lifting and lowering structure 600 further includes a flexible connection member (not shown) connected between the first fixed bracket 601 and the second fixed bracket 602. When the operation surface is uneven, the second fixed bracket 602 moves vertically relative to the first fixed bracket 601 through the flexible connection member.

In the dry-cleaning module, the four-link floating lifting and lowering structure is provided, so that the dry-cleaning module is moved vertically relative to the mobile platform. When encountering an obstacle during operation, the cleaning apparatus can easily cross over the obstacle through the four-link floating lifting and lowering structure, thereby avoiding damage to the cleaning apparatus by the obstacle.

Finally, it should be noted that the various embodiments in the description are described in a progressive manner, each embodiment focuses on the differences from the other embodiments, and the same or similar parts among the various embodiments may refer to one another. For the system or device disclosed in the embodiments, since it corresponds to the method disclosed in the embodiments, the description is relatively simple, and the relevant parts may refer to the description of the method section.

The above embodiments are only used to illustrate the technical solutions of the present disclosure and are not intended to limit the present disclosure. Although the present disclosure has been described in detail with reference to the foregoing embodiments, those of ordinary skill in the art should understand that they can still make modifications to the technical solutions described in the foregoing embodiments, or make equivalent substitutions to some of the technical features; and these modifications or substitutions do not deviate the nature of the corresponding technical solutions from the spirit and scope of the technical solutions of the various embodiments of the present disclosure.

What is claimed is:

1. An automatic cleaning apparatus, comprising:

a mobile platform, configured to move automatically on an operation surface; and a cleaning module, disposed on the mobile platform and comprising:

a dry-cleaning module, configured to clean at least a part of the operation surface by means of dry cleaning;

a wet-cleaning module, configured to clean at least a part of the operation surface by means of wet cleaning; and a lifting and lowering structure, connected to the wet-cleaning module and configured to enable the wet-cleaning module to move vertically relative to the mobile platform, wherein the wet-cleaning module comprises: a cleaning head for cleaning the operation surface, and a driving unit for driving the cleaning head to reciprocate along a target surface, the target surface being a part of the operation surface, wherein the lifting and lowering structure is a parallelogram structure and comprises:

a first connection end, for providing active power to switch the dry-cleaning module or the wet-cleaning module between a lifted state and a lowered state; and a second connection end, disposed opposite to the first connection end, wherein the second connection end is configured to rotate under the action of the active power, wherein the first connection end comprises: a first bracket fixedly connected to the bottom of the mobile platform, wherein the first bracket comprises:

a cross beam;

a sliding slot, extending along a surface of the cross beam; and a snapping hole, passing through the cross beam and disposed at an extending end of the sliding slot.

2. The automatic cleaning apparatus according to claim 1, wherein the first connection end further comprises:

a first connection rod pair, one end of which is rotatably connected to the mobile platform, and the other end of which is rotatably connected to the dry-cleaning module or the wet-cleaning module, wherein the first connection rod pair comprises a first connection rod and a second connection rod that are arranged in parallel, and wherein a first end of each of the first connection rod and the second connection rod is rotatably connected to the mobile platform through a movable stud, and a second end of each of the first connection rod and the second connection rod is rotatably connected to the wet-cleaning module through a movable stud.

3. The automatic cleaning apparatus according to claim 2, wherein the lifting and lowering structure further comprises a cable for providing a pulling force to rotate the first connection rod pair within a preset angle, wherein the cable comprises:

a cable motor terminal connected to the driving unit; and a cable bracket terminal connected to the first bracket, wherein the second end of each of the first connection rod and the second connection rod is lifted or lowered by a motor through the cable.

4. The automatic cleaning apparatus according to claim 3, wherein the second connection end comprises a second connection rod pair, one end of which is rotatably connected to the mobile platform, and the other end of which is rotatably connected to the wet-cleaning module, wherein the second connection rod pair rotates with the rotation of the first connection rod pair.

5. The automatic cleaning apparatus according to claim 4, wherein the second connection rod pair comprises a third connection rod and a fourth connection rod that are arranged in parallel, wherein a first end of each of the third connection rod and the fourth connection rod is rotatably connected to the mobile platform through a movable stud, and a second end of each of the third connection rod and the fourth connection rod is rotatably connected to the wet-cleaning module through a movable stud.

6. An automatic cleaning apparatus, comprising:

a mobile platform, configured to move automatically on an operation surface; and a cleaning module, disposed on the mobile platform and comprising:

a dry-cleaning module, configured to clean at least a part of the operation surface by means of dry cleaning;

a wet-cleaning module, configured to clean at least a part of the operation surface by means of wet cleaning; and a lifting and lowering structure, connected to the wet-cleaning module and configured to enable the wet-cleaning module to move vertically relative to the mobile platform, wherein the wet-cleaning module comprises: a cleaning head for cleaning the operation surface, and a driving unit for driving the cleaning head to reciprocate along a target surface, the target surface being a part of the operation surface, wherein the lifting and lowering structure is a parallelogram structure and comprises:

a first connection end, for providing active power to switch the dry-cleaning module or the wet-cleaning module between a lifted state and a lowered state; and a second connection end, disposed opposite to the first connection end, wherein the second connection end is configured to rotate under the action of the active power, wherein the first connection end comprises: a first bracket fixedly connected to the bottom of the mobile platform, wherein the first bracket comprises:

a cross beam;

a sliding slot, extending along a surface of the cross beam; and a snapping hole, passing through the cross beam and disposed at an extending end of the sliding slot, wherein the driving unit comprises:

a driving platform, connected to a bottom surface of the mobile platform for providing a driving force; and a support platform, detachably connected to the driving platform for supporting the cleaning head.

7. The automatic cleaning apparatus according to claim 6, wherein the driving platform comprises:

a driving wheel, connected to a motor output shaft and having an asymmetric structure; and a vibrating member, disposed on a side of the driving platform opposite to a motor and connected to the driving wheel, wherein the vibrating member is configured to reciprocate under the asymmetrical rotation of the driving wheel.

8. The automatic cleaning apparatus according to claim 7, wherein the driving platform further comprises:

a connection rod, extending along an edge of the driving platform and used for connecting the driving wheel and the vibrating member so that the vibrating member extends to a preset position.

9. The automatic cleaning apparatus according to claim 8, wherein the driving platform further comprises a vibration buffer device disposed on the connection rod for reducing vibration in a specific direction.

10. The automatic cleaning apparatus according to claim 9, wherein the support platform comprises:

a cleaning substrate disposed movably on the support platform, wherein the cleaning substrate is configured to reciprocate relative to the support platform under the vibration of the vibrating member.

11. The automatic cleaning apparatus according to claim 10, wherein the support platform further comprises:

a detaching button, disposed on at least one side of the support platform for detachably connecting the support platform to the driving platform.

12. The automatic cleaning apparatus according to claim 11, wherein the support platform further comprises:

at least one assembling region, disposed on the support platform for assembling the cleaning head.

13. The automatic cleaning apparatus according to claim 12, wherein the cleaning head comprises:

a movable region connected to the cleaning substrate, wherein the movable region is configured to reciprocate along the target surface under the driving of the cleaning substrate; and a fixed region connected to the bottom of the support platform through the at least one assembling region, wherein the fixed region is configured to clean at least a part of the operation surface along with the movement of the support platform.

14. The automatic cleaning apparatus according to claim 13, wherein the cleaning head further comprises:

a flexible connection portion, disposed between the fixed region and the movable region for connecting the fixed region and the movable region.

15. The automatic cleaning apparatus according to claim 14, wherein the cleaning head further comprises:

a sliding buckle, extending along an edge of the cleaning head and detachably mounted on the support platform.

* * * * *